US008684862B2

(12) United States Patent
Tavares et al.

(10) Patent No.: US 8,684,862 B2
(45) **Date of Patent: *Apr. 1, 2014**

(54) GOLF CLUBS AND GOLF CLUB HEADS HAVING FEEL ALTERING SYSTEMS

(75) Inventors: Gary G. Tavares, Azle, TX (US); John T. Stites, Weatherford, TX (US); Robert Boyd, Euless, TX (US); Hiroshi Kawaguchi, Southlake, TX (US)

(73) Assignee: Nike, Inc., Beaverton, OR (US)

( * ) Notice: Subject to any disclaimer, the term of this patent is extended or adjusted under 35 U.S.C. 154(b) by 204 days.

This patent is subject to a terminal disclaimer.

(21) Appl. No.: 13/104,660

(22) Filed: May 10, 2011

(65) Prior Publication Data

US 2011/0212794 A1 Sep. 1, 2011

Related U.S. Application Data

(60) Continuation of application No. 12/789,146, filed on May 27, 2010, now Pat. No. 7,963,860, which is a division of application No. 11/367,750, filed on Mar. 6, 2006, now Pat. No. 7,744,487.

(51) Int. Cl.
*A63B 53/06* (2006.01)

(52) U.S. Cl.
USPC ..... 473/332; 473/334; 473/345; 473/349; 473/350

(58) Field of Classification Search
USPC ..... 473/290–291, 334–339, 324, 350, 332, 473/345, 349
See application file for complete search history.

(56) References Cited

U.S. PATENT DOCUMENTS

| | | | |
|---|---|---|---|
| 4,928,972 | A | 5/1990 | Nakanishi et al. |
| 4,964,640 | A | 10/1990 | Nakanishi et al. |
| 5,064,197 | A | 11/1991 | Eddy |
| 5,244,211 | A | 9/1993 | Lukasiewicz |
| 5,290,036 | A | 3/1994 | Fenton et al. |
| 5,904,628 | A | 5/1999 | MacKay, Jr. et al. |
| 6,019,687 | A | 2/2000 | Blowers |
| 6,077,173 | A | 6/2000 | Stites |

(Continued)

FOREIGN PATENT DOCUMENTS

| | | |
|---|---|---|
| JP | 09239077 | 9/1997 |
| JP | 2001-321473 | 11/2001 |
| WO | 2005063340 | 7/2005 |
| WO | 2006017605 | 2/2006 |

OTHER PUBLICATIONS

Office Action of Chinese Patent Application No. 200780010980.1, dated Dec. 21, 2011, in English language.

(Continued)

*Primary Examiner* — Stephen L. Blau
(74) *Attorney, Agent, or Firm* — Banner & Witcoff, Ltd.

(57) ABSTRACT

Golf club heads include: (a) a body having a ball-striking face and a rear face, the body defining a cavity; (b) a bridge member extending across the cavity, wherein the bridge member is provided to affect, at least in part, a position of a center of gravity of the club head; and (c) a feel altering element provided between the bridge member and the rear face. The feel altering element may affect a wide variety of parameters that relate to the "feel" of the golf club head when it strikes a golf ball, such as the sound produced by the club head during the strike, the vibrational response of the club head during the strike, the swing characteristics of the club head (e.g., weight, center of gravity position, etc.), and the like.

26 Claims, 12 Drawing Sheets

(56) References Cited

U.S. PATENT DOCUMENTS

| | | | |
|---|---|---|---|
| 6,450,897 | B2 | 9/2002 | Stites et al. |
| 6,805,643 | B1 | 10/2004 | Lin |
| 6,902,495 | B2 | 6/2005 | Pergande et al. |
| 7,147,571 | B2 | 12/2006 | Best et al. |
| 2004/0110575 | A1 | 6/2004 | Stites et al. |
| 2004/0266550 | A1 | 12/2004 | Gilbert et al. |
| 2005/0009625 | A1 | 1/2005 | Stites et al. |
| 2005/0009626 | A1 | 1/2005 | Imamoto et al. |
| 2005/0064951 | A1 | 3/2005 | Stites et al. |
| 2005/0096151 | A1 | 5/2005 | Hou et al. |
| 2005/0119066 | A1 | 6/2005 | Stites et al. |
| 2005/0124437 | A1 | 6/2005 | Imamoto |
| 2005/0137024 | A1 | 6/2005 | Stites et al. |
| 2006/0223652 | A1 | 10/2006 | Hou |
| 2007/0149318 | A1 | 6/2007 | Imamoto et al. |

OTHER PUBLICATIONS

Office Action of Taiwan Patent Application No. 96107349, dated Nov. 29, 2011, with English summary.

English translation of Reasons for Rejection dated May 27, 2013, from JP Application No. 2011-180136.

Chinese Office Action in Chinese Patent Application No. 200780010980.1, dated Apr. 15, 2013.

English translation of Korean Office Action dated Apr. 22, 2013, from KR Application No. 10-2008-7022978.

Copy of International Search Report from PCT Application No. PCT/US2007/005221, mailed Oct. 16, 2007.

Office Action of Taiwan Patent Application No. 96107349, dated Jul. 13, 2011.

GOLF CLUBS AND GOLF CLUB HEADS HAVING FEEL ALTERING SYSTEMS

CROSS-REFERENCE TO RELATED APPLICATIONS

This application is a continuation of copending U.S. patent application. Ser. No. 12/789,146, filed May 27, 2010, which is a divisional of U.S. patent application. Ser. No. 11/367,750, filed Mar. 6, 2006, which issued Jun. 29, 2010 as U.S. Pat. No. 7,744,487, and claims priority to such applications, which applications are incorporated by reference herein in their entireties and made part hereof.

FIELD OF THE INVENTION

The present invention relates to golf clubs and golf club heads. Particular example aspects of this invention relate to golf clubs and golf club heads having a bridge member and a feel altering system to modify the feel characteristics of the club head when a ball is struck. Features of golf clubs and golf club heads in accordance with at least some examples of this invention may be similar to structures described in U.S. patent application Ser. No. 10/666,346, filed Sep. 19, 2003 and U.S. patent application Ser. No. 10/707,599, filed Dec. 23, 2003. These earlier applications are entirely incorporated herein by reference.

BACKGROUND

Various golf club heads have been designed to improve a golfer's accuracy by assisting the golfer in squaring the club head face at impact with a golf ball. A number of golf club heads reposition the weight of the golf club head in order to alter the location of the club head's center of gravity. The location of the center of gravity of the golf club head is one factor that determines whether a golf ball is propelled in the intended direction. When the center of gravity is positioned behind the point of engagement on the contact surface, the golf ball follows a generally straight route. When the center of gravity is spaced to a side of the point of engagement, however, the golf ball may fly in an unintended direction and/or may follow a route that curves left or right, ball flights that are often referred to as "pulls," "pushes," "draws," "fades," "hooks," or "slices". Similarly, when the center of gravity is spaced above or below the point of engagement, the route of the golf ball may exhibit more boring or climbing trajectories, respectively.

Golf club heads, such as cavity back club heads, assist the golfer by locating much of the weight of the golf club head around the golf club head perimeter. Generally, these golf club heads are more forgiving than non-cavity back golf club heads thereby allowing a golf ball to be struck somewhat off center or mis-hit, while still providing relatively good distance and accuracy. Cavity back club heads have helped the average golfer reduce mis-hits and improve scoring.

Golfers tend to be sensitive to the "feel" of a golf club. The "feel" of a golf club comprises the combination of various component parts of the club and various features associated with the club that produce the sensory sensations experienced by the player when a ball is swung at and/or struck. Club weight, weight distribution, aerodynamics, swing speed, and the like all may affect the "feel" of the club as it swings and strikes a ball. "Feel" also has been found to be related to the sound produced when a club head strikes a ball to send the ball in motion. If a club head makes an unpleasant, undesirable, or surprising sound at impact, a user may flinch, give up on his/her swing, decelerate the swing, and/or not completely follow-through on the swing, thereby affecting distance, direction, and/or other performance aspects of the swing and the resulting ball motion. User anticipation of this unpleasant, undesirable, or surprising sound can affect a swing even before the ball is hit.

SUMMARY OF THE INVENTION

Golf club heads according to at least some example aspects of this invention include: (a) a body having a ball-striking face and a rear face opposite the ball-striking face, the body further defining a rear cavity; (b) a bridge member extending across at least a portion of the rear cavity (e.g., in a direction generally from the club head toe portion to the club head heel portion, etc.), wherein the bridge member is provided to affect, at least in part, a position of a center of gravity of the golf club head with respect to the striking face; and (c) a feel altering element provided between the bridge member and the rear face. The feel altering element may affect a wide variety of parameters that relate to the "feel" of the golf club head when it strikes a golf ball, such as the sound produced by the club head during the strike, the vibrational response of the club head resulting from the strike, the swing characteristics of the club head (e.g., weight, center of gravity position, etc.), and the like. Various weighted members and weight positioning control elements and structures also may be provided as part of the club head structure, optionally engaged with the bridge member, to allow further variation and/or control of the position of the center of gravity of the club head.

BRIEF DESCRIPTION OF THE DRAWINGS

The present invention is illustrated by way of example and not limited in the accompanying figures, in which like reference numerals indicate similar elements throughout, and in which.

DETAILED DESCRIPTION

Figure 1:
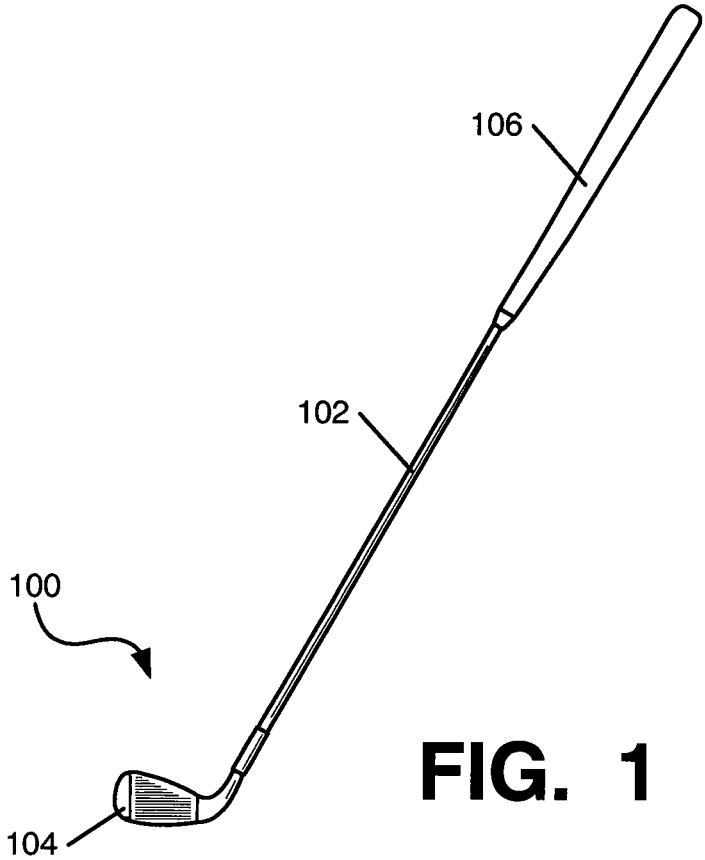
FIG. 1 illustrates a view of an example golf club having an example golf club head in accordance with the present invention.

The following description and the accompanying figures disclose features of golf clubs in accordance with the present invention (e.g., iron or hybrid type golf clubs and golf club heads). Each golf club includes a golf club head with a feel altering system for varying at least some aspect of the club's "feel," such as the sound emitted during a golf ball strike, a vibrational response of the club, etc.

I. GENERAL DESCRIPTION OF ASPECTS OF THE INVENTION

Aspects of this invention relate to golf club heads and golf clubs including such golf club heads. Golf club heads according to at least some example aspects of this invention may include: (a) a body having a ball-striking face and a rear face opposite the ball-striking face, the body further defining a rear cavity; (b) a bridge member extending across at least a portion of the rear cavity (e.g., in a direction generally from the club head toe portion to the club head heel portion, etc.), wherein the bridge member is provided to affect, at least in part, a position of a center of gravity of the golf club head; and (c) a feel altering element provided between the bridge member and the rear face (e.g., in the rear cavity). The feel altering element may affect a wide variety of parameters that relate to the "feel" of the golf club head when it is swung at and/or strikes a golf ball, such as the sound produced by the club head during the strike, the vibrational response of the club head during the strike, the swing characteristics of the club head (e.g., weight, center of gravity position, etc.), and the like. In at least some examples, the feel altering element may constitute a polymeric material, such as a polymeric shell material, a fluid-tight chamber filled with air or other fluid, optionally air or other gas under pressure, and the like.

Additional example golf club head structures in accordance with this invention may include the following: (a) a club head body having a heel, a toe, a top portion, a sole portion, a striking face extending from the top portion to the sole portion, the striking face providing a contact area for engaging a golf ball, and a rear face opposite the striking face, the club head body further defining a first rear cavity; (b) a bridge member extending across at least a portion of the first rear cavity (e.g., in a direction generally from the toe to the heel, etc.); (c) a feel altering element (e.g., like those described above and described in more detail below) provided between the bridge member and the rear face; (d) a first wall extending from the sole portion to the bridge member, the first wall forming a second rear cavity, the second rear cavity and the bridge member provided to affect, at least in part, a position of a center of gravity of the golf club head with respect to the striking face; and/or (e) a second wall extending from the top portion to the bridge member, the second wall forming a third rear cavity, the third rear cavity and the bridge member provided to affect, at least in part, the position of the center of gravity of the golf club head with respect to the striking face. While club heads may include both the first wall and the second wall described above or a single wall extending from the sole portion to the top portion of the club head, at least some example club head structures according to the invention will include only the first wall (extending from the sole portion to the bridge member) and other example club head structures according to the invention will include only the second wall (extending from the top portion to the bridge member).

Still other example golf club head structures in accordance with this invention will include: (a) a body having a striking face with a contact area for engaging a golf ball, the body further having a rear cavity opposite the striking face; (b) a bridge member extending across at least a portion of the rear cavity; (c) a feel altering element (e.g., of the types described above and described in more detail below) provided between the bridge member and the rear face; and (d) at least one weight member engaged with the bridge member and provided to affect, at least in part, a position of a center of gravity of the golf club head with respect to the striking face. The weight member(s) may be movably mounted on the bridge member and selectively adjustable so as to permit control of the position of the center of gravity of golf club head in one or more different directions (e.g., by moving the weight members to discrete, separate locations; by sliding the weight member(s) to different locations; by rotating the weight members to different rotational positions; etc.). Additionally, if desired, one or more of the weight members may be disengageable from the bridge member to allow exchange with different weight members, optionally weight members having different weights, weight distributions, and/or other characteristics, to allow further selectivity and control of the position of the center of gravity of the club head.

If desired, in accordance with at least some examples of this invention, the bridge member of the club head may include a weight positioning assembly integral therewith. This weight positioning assembly may include, for example, a rail and one or more weight members movably (and optionally removably) connected to the rail, wherein the weight member(s) is (are) movable along the rail so as to allow, at least in part, selective variation and control of a position of a center of gravity of the golf club head in at least a first direction. Additionally, if desired, the weight member(s) may be rotatable about an axis and not symmetrically weighted so as to allow, at least in part, further variation and control on the position of the center of gravity of the golf club head, e.g., in a second direction with respect to the striking face.

Still further aspects of this invention relate to golf clubs. Golf clubs in accordance with at least some examples of the invention may include golf club heads, bridge members, one or more weighted members, and/or one or more feel altering elements of the various types described above. Golf clubs in accordance with examples of this invention further may include shaft members extending from the club head bodies, grip elements attached to the shaft members, and/or other features, including conventional features known and used in the art.

Still additional aspects of this invention relate to sets of golf club heads and/or sets of golf clubs including golf club heads according to this invention. The sets of golf club heads and golf clubs may be provided with progressively differing striking face angles, lie angles, bridge member locations and/or other characteristics, weighted member and/or other weighting characteristics, and the like so as to provide a set of golf clubs (e.g., irons), for example, from long irons (e.g., two or more of zero irons through five irons) to short irons (e.g., two or more of six irons through various wedge designs), with differing center of gravity locations.

Given the general description of aspects of the invention provided above, more detailed descriptions of various specific examples of golf clubs and golf club head structures according to the invention are provided below.

II. DETAILED DESCRIPTION OF EXAMPLE GOLF CLUB HEADS AND GOLF CLUB STRUCTURES ACCORDING TO THE INVENTION

The following discussion and accompanying figures describe various golf clubs and golf club head structures in accordance with examples of the present invention. As more specific examples, golf club heads in accordance with examples of the present invention may be utilized for long iron clubs (e.g., driving irons, zero irons through five irons, and hybrid type golf clubs) and for short iron clubs (e.g., six irons through pitching wedges, as well as sand wedges, lob wedges, gap wedges, and/or other wedges). In the more detailed description that follows, FIGS. 1-5A illustrate examples of long iron clubs including example aspects of the present invention, while, FIGS. 6-9 illustrate examples of short iron clubs including example aspects of the present invention. Of course, if desired, any iron or hybrid club head could have the structures shown in FIGS. 1-5A and/or any iron or hybrid club head could have the structures shown in FIGS. 6-9 without departing from the invention.

Referring to FIG. 1, a golf club 100 in accordance with at least some examples of this invention includes a shaft 102 and a golf club head 104 attached to the shaft 102. The golf club head 104 of FIG. 1 may be representative of any iron or hybrid type golf club head in accordance with examples of the present invention. The shaft 102 of golf club 100 may be made of various materials, such as steel, titanium, graphite, or a composite material, as well as combinations thereof, including materials that are conventionally known and used in the art. Additionally, the shaft 102 may be attached to the club head 104 in any desired manner, including in conventional manners known and used in the art (e.g., via adhesives or cements at a hosel element, via threads or other mechanical connectors, etc.). A grip element 106 is positioned on the shaft 102 to provide a golfer with a slip resistant surface with which to grasp golf club shaft 102. The grip element 106 may be attached to the shaft 102 in any desired manner, including in conventional manners known and used in the art (e.g., via adhesives or cements, threads or other mechanical connectors, etc.).

Figure 2:
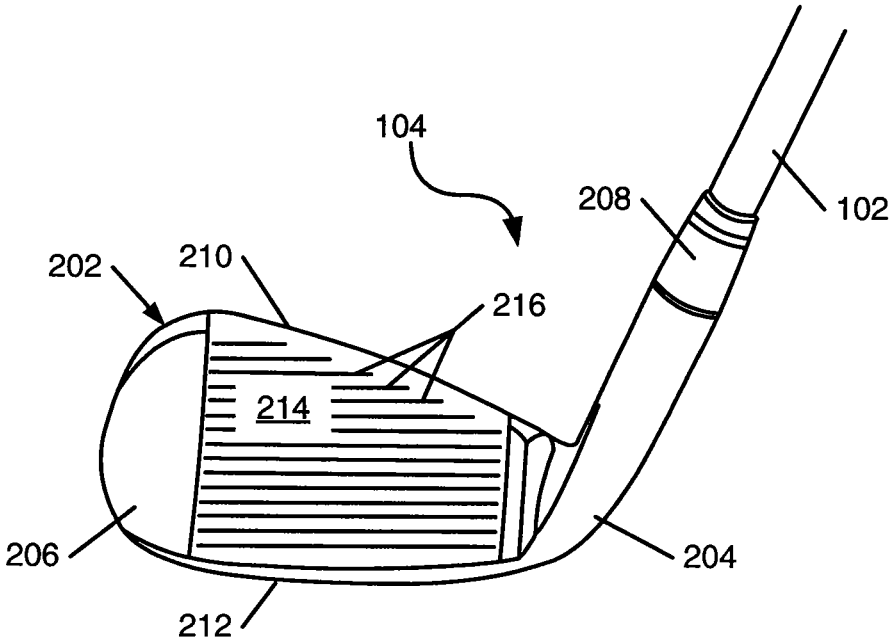
FIG. 2 illustrates a front view of an example golf club head in accordance with the present invention.

As shown in FIG. 2, the golf club head 104 includes a body member 202 that includes a heel portion 204 and a toe portion 206. The heel portion 204 is attached to and/or extends from a hosel 208 (e.g., as a unitary or integral one piece construction, as separate connected elements, etc.) for connecting the shaft 102 to the golf club head 104. The body member 202 also includes a top portion 210 and a sole portion 212. A striking face 214 is provided between the top portion 210 and the sole portion 212, and between the toe 206 and the heel 204. The striking face 214 provides a contact area for engaging and propelling a golf ball in an intended direction. The striking face 214 may include grooves 216 (e.g., generally horizontal grooves 216 extending across the face 214 in the illustrated example) for the removal of water and grass from the striking face 214 during a ball strike. Of course, any number of grooves, desired groove patterns, and/or groove constructions may be provided (or even no groove pattern, if desired), including conventional groove patterns and/or constructions, without departing from this invention.

The body member 202 of the golf club head 104 may be constructed from a wide variety of different materials, including materials conventionally known and used in the art, such as steel, titanium, aluminum, tungsten, graphite, polymers, or composites, or combinations thereof. Also, if desired, the club head 104 may be made from any number of pieces (e.g., having a separate face plate, etc.) and/or by any construction technique, including, for example, casting, forging, welding, and/or other methods known and used in the art.

Figure 3:
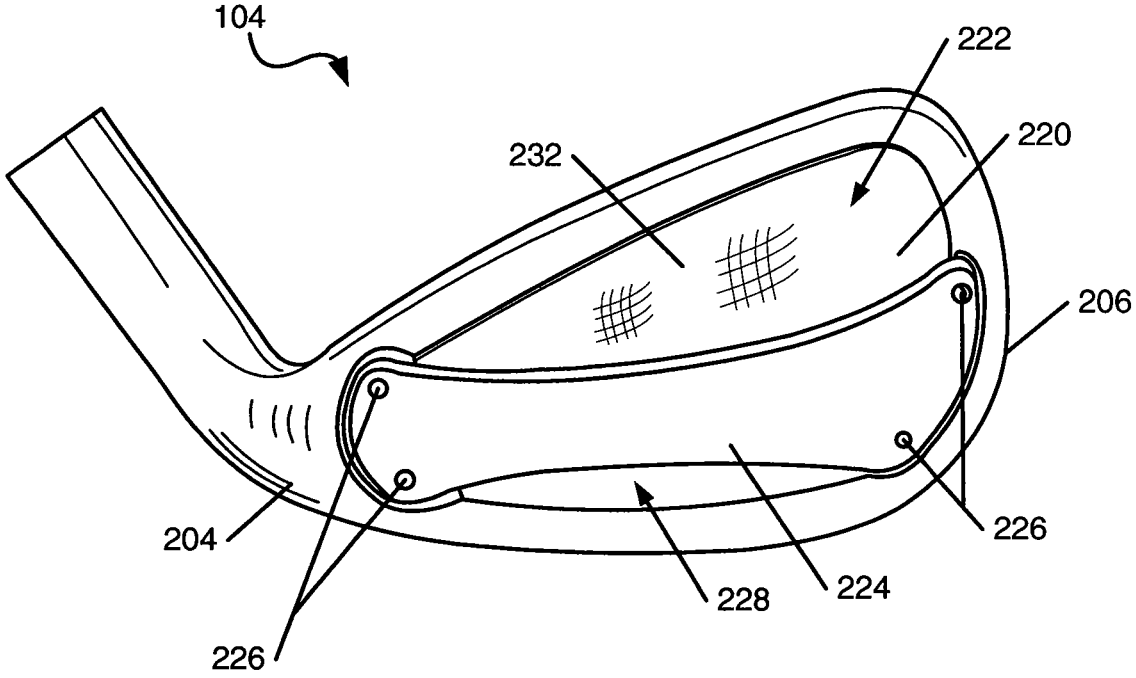
FIG. 3 illustrates a rear view of an example golf club head in accordance with the present invention.

FIG. 3 illustrates a rear view of a golf club head 104 in accordance with at least some examples of this invention. This example golf club head 104 includes a rear face 220 positioned opposite the striking face 214. The club head body member 202 further forms or defines a first rear cavity 222, which in this example club head structure 104 includes a large opening. A bridge member 224 extends across the first rear cavity 222, and this bridge member 224 may connect the heel portion 204 of the club head 104 to the toe portion 206. Bridge member 224 may extend across the first rear cavity 222 in other directions and may be connected at various other locations on a golf club head structure without departing from the invention, as shown, for example, in U.S. Pat. No. 6,450,897 issued on Sep. 17, 2002 to John T. Stites, et al., which patent is entirely incorporated herein by reference. Bridge member 224 may have any desired shape, such as rectangular, oval, triangular, trapezoidal, square, or other symmetrical or asymmetrical shapes. Bridge member 224 also may have a uniform or non-uniform width or thickness throughout its length.

Bridge member 224 may be connected to the toe portion 206 and/or the heel portion 204 (or other portion(s)) of the club head 104 in any desired manner, including through the use of mechanical connectors (such as rivets or screws 226) or fusion techniques (such as welding, soldering, brazing, etc.). Those skilled in the art will recognize that bridge member 224 may be connected to the toe portion 206 and/or the heel portion 204 using fewer or additional connection points or elements and/or through numerous other connection means and/or techniques without departing from the present invention. As still additional examples, if desired, bridge member 224 may be formed with the golf club head 104 in a single casting and/or as a single unitary element, thereby making the bridge member 224 a one piece construction with the golf club head 104. Cements or adhesives also may be used to secure the bridge member 224 to the club head 104, if desired, without departing from this invention.

Figure 4:
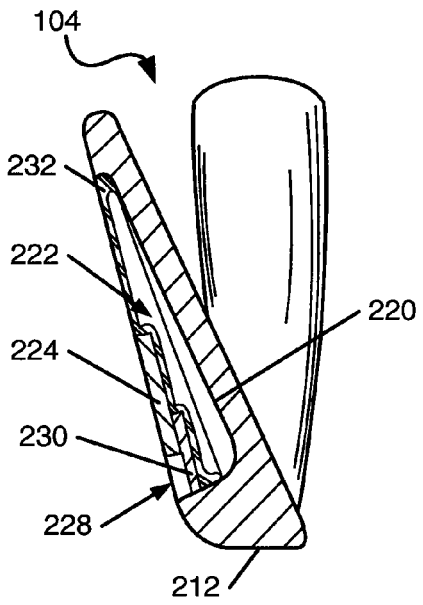
FIGS. 4 and 4A illustrate cross-sectional views of example golf club heads in accordance with the present invention.
Figure 4A:
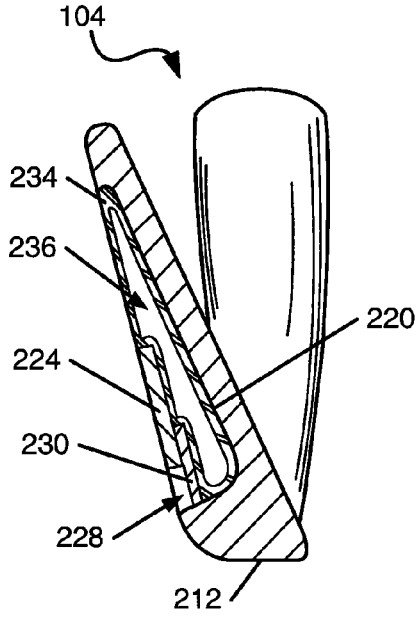

In the golf club head structure 104 according to this illustrated example of the invention, a second rear cavity 228 is provided below the bridge member 224, as shown in FIG. 3. With reference to FIGS. 4 and 4A, cross-sectional views of example golf club heads 104 are illustrated. In these example arrangements, a wall 230 extends from the sole portion 212 of the club head 104 to the bridge member 224. The wall 230, at least in part, creates or defines the second rear cavity 228, which includes an opening positioned below bridge member 224 in this club head structure 104. The wall 230 may be formed so as to include a front surface (facing outward, toward second cavity 228), a back surface (facing inward, toward first cavity 222), a top surface, and a bottom surface. If desired, a space may exist between the back surface of wall 230 and the rear face 220 of the golf club head 104.

The wall 230 may be integrally formed with the club head 104 and/or the bridge member 224, e.g., to provide additional support and stiffness to the bridge member 224. Wall 230 may be linear, curved, or otherwise shaped, e.g., optionally depending upon the shape of bridge member 224, the shape of the club head 104, desired aesthetics, etc. Like the club head 104, the wall 230 and/or the bridge member 224 may be made from a wide variety of materials, such as stainless steel, titanium, graphite, plastic, a composite material, combinations thereof, and/or other materials conventionally used in golf club head construction and manufacture. Also, the club head 104, the wall 230, and the bridge member 224 may be made from the same or different materials without departing from this invention. The additional support and stiffness to bridge member 224 provided by the wall 230, if any, may help prevent or reduce deformation of bridge member 224 upon contact with a golf ball. In addition, if desired, the wall 230 may provide at least some vibration damping effect upon impact of striking face 214 with a golf ball.

The wall 230 may be secured in the club head structure 104 (e.g., to the bridge member 224 and/or to other portions of the club head 104) in any desired manner without departing from this invention. As some more specific examples, the front surface and/or the bottom surface of wall 230 may be secured to the bridge member 224 and the sole portion 212, respectively, using an adhesive or cement. Optionally, if desired, the wall 230 may fit into grooves or recessed areas provided in the surfaces of the bridge member 224 and/or the sole portion 212. Those skilled in the art will recognize that numerous other ways exist to attach the wall 230 to the bridge member 224 and sole portion 212 (or to other portions of the club head structure 104) without departing from this invention. These numerous other ways of attachment are contemplated and fall within the scope of the present invention. Also, if desired, the wall 230 may be made of multiple pieces that extend continuously or discontinuously, e.g., along the bridge member 224.

Figure 3A:
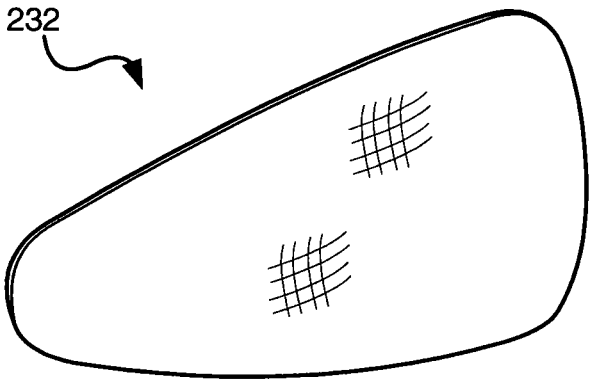
FIG. 3A illustrates an example feel altering element that may be included in a golf club head structure in accordance with the present invention.

FIGS. 3 and 4 further illustrate inclusion of a feel altering element 232 as part of the club head structure 104. FIG. 3A illustrates an example of a feel altering element 232 for this club head structure 104 in more detail. As shown, the feel altering element 232 of this illustrated example is a shell or plate member that fits in the first recess cavity 222, between the bridge member 224 and the rear surface 220 of the club head structure 104. The feel altering element 232 may be made from any desired materials without departing from this invention, including, for example, plastic or polymeric materials, metals, ceramics, fabrics, textiles, natural or synthetic rubbers, or the like. In accordance with at least some examples of the invention, the feel altering element 232 will be made of a polymeric material formed as a shell or plate member, such as plastic materials like polyethylenes, polypropylenes, polystyrenes, polyvinylchlorides, and the like. The feel altering element may be relatively stiff so as to at least generally hold its own shape, or it may be rather flexible to enable it to fill and/or at least generally take the shape of the recess into which it is fit.

The inclusion of the feel altering element 232 may be used to control or change various feel aspects of the club head 104, such as the sound emitted by the club head 104 during contact with a golf ball, the swing weight and/or center of gravity characteristics of the club head 104, the vibrational response of the club head 104 during contact with a golf ball (e.g., to reduce or eliminate a "stinging" or other undesirable vibrational sensation to the user's hands, etc.), and the like. The material, its positioning, its thickness, its size, and the like of the feel altering element 232 may be used to "tune" the golf club's feel to a feel desired by club designers and/or individual users.

FIGS. 3, 3A, and 4 illustrate the feel altering element 232 as a single piece, single plate or shell material that fits into the first recess cavity 222 and essentially covers the entire cavity 222. Any manner of holding the feel altering element 232 in place may be used without departing from this invention. For example, adhesives or cements may be used to hold the element 232 in place in the cavity 222 and/or against bridge member 224. As additional examples, if desired, an edge or projection on the edge of the feel altering element 232 may fit into a groove, slot, or other receptacle provided in the club head structure 104 (e.g., on the perimeter of the recess cavity 222, in the rear face 220, in the sole portion 212, etc.) or vice versa. As still additional examples, if desired, the feel altering element 232 may be held in place via a friction fit or due to a spring-like or expansion effect of the element 232's construction. Additionally, if desired, the feel altering element 232 may be made from multiple pieces and/or it need not completely fill the rear cavity 222.

Other feel altering element structures are possible without departing from this invention. For example, in the example club head structure 104 illustrated in FIG. 4A, the feel altering element 234 defines a chamber 236, optionally a fluid-tight chamber. Optionally, if desired, a fluid (e.g., a gas or liquid, such as air, water, nitrogen, noble gasses, or the like) may be provided in the chamber 236 to allow further changes to the sound, vibrational response, and/or other feel characteristics generated by the club head 104 in use. If desired, the fluid in the chamber 236 may be pressurized, which can be used to provide still different sound, vibrational response, or other feel characteristics to the club head structure 104 during use.

The feel altering element 234 may be held in place in the club head structure 104 in any desired manner without departing from the invention, including in the various ways described above for element 232. Optionally, if desired, a retaining element (such as wall 230, an annular ring or other retaining device, or the like) may be provided to help hold the element 234 in place in the club head structure 104. The element 234 may be made of any desired materials, including rigid, flexible, or pliable materials, e.g., of the various types described above for element 232. In some examples, the element 234 will be an air bladder or air bag type structure, optionally quite flexible to conform to the shape of the recess in which it is placed. Also, if desired, multiple elements 234 or various combinations of elements 232 and 234 may be provided in an individual club head structure 104 without departing from this invention.

During the game of golf, an individual holds the grip 106 and swings the golf club 100 such that club head 104 traverses a generally arcuate path and impacts a golf ball. A portion of the inertia of the golf club 100, and particularly the inertia of the golf club head 104, then is transferred to the golf ball to propel the golf ball. The position of a center of gravity of the club head 104 during the ball strike has an influence upon the ball's flight, e.g., whether the golf ball curves right, curves left, or follows a generally straight route, as well as the extent of the curvature and/or the direction of the route. The golf ball will follow a generally straight route when the club head 104's center of gravity is positioned directly behind the point of engagement of the ball with the striking face 214. When the club head 104's center of gravity is spaced to one side of this point of engagement with the ball, however, the golf ball may follow a route that curves left or right. The position of the center of gravity of golf club head 104 during contact with a ball also will influence whether the golf ball exhibits a low, boring trajectory or a high, climbing trajectory, depending upon whether the center of gravity is spaced above or below the point of engagement of the ball on striking face 214.

Although the concepts behind utilizing a golf club 100 to propel a golf ball toward an intended target appear relatively simple, the actual practice of propelling the golf ball in an intended manner can be quite difficult. The golf ball may, for example, consistently curve right when, in fact, the individual intends to propel the golf ball along a substantially straight route. Many conventional golf club heads have a center of gravity located at the striking face. However, changing the position of the center of gravity of the golf club head 104 for different golf clubs may assist many golfers in squaring the club head face 104 upon impact with a golf ball and better propelling the ball along its intended path. Positioning the center of gravity away from the striking face 214 and toward the rear of the golf club head 104 may conform to the play characteristics, style, and preferences of many golfers. Accordingly, golfers may be able to correct or modify the route of a golf ball by using the golf club head 104 of the present invention as the center of gravity of golf club head 104 is repositioned with respect to striking face 214 as compared to other golf club heads.

The center of gravity of golf club head 104, also referred to herein as its "center of mass," is defined as an equilibrium point. More specifically, the center of gravity of golf club head 104 is a point at which the entire weight of golf club head 104 may be considered as concentrated so that, if supported at that point, the club head 104 would remain in static equilibrium in any position. The location of the center of gravity of golf club head 104 may be changed by altering the weight distribution of the golf club head 104, e.g., by positioning additional weight away from the striking face 214. Altering the weight distribution of golf club head 104 in accordance with at least some examples of this invention (such as the examples illustrated in FIGS. 3, 4, and 4A) may be accomplished, at least in part, with the use of bridge member 224, wall 230, and/or feel altering elements 232 and/or 234.

For example, bridge member 224 may be used to increase the weight of the back of the golf club head 104 relative to the striking face 214. This increase in weight toward the rear of golf club head 104 alters the position of the center of gravity of golf club head 104. By moving the center of gravity lower and toward the rear of the golf club head 104, the golf club 100 will tend to have an increased loft upon impact with a golf ball. In addition, the shape, location, and weight distribution of bridge member 224 also may influence the location of the center of gravity of golf club head 104. For example, on longer iron clubs (e.g., driving irons, zero through five irons, and/or hybrid clubs), it may be desirable for at least some golfers to have the center of gravity lower than on the shorter iron clubs. On the longer iron or hybrid clubs, a lower center of gravity typically will assist a golfer in obtaining additional loft and lift on their golf shot, enabling them to better get these shots airborne. Therefore, in accordance with at least some examples of this invention, the bridge member 224 for driving irons, longer iron clubs, and/or hybrid type clubs may be positioned lower on the rear of the golf club head body 104 as compared to the bridge member 224 position on a shorter iron club.

The lowering of the center of gravity of the golf club head 104 also may be accomplished, at least in part, through the use of wall 230 or the feel altering elements 232 and 234. These elements 230, 232, and/or 234 also may be used to increase the weight of the back of the golf club head 104 relative to the striking face 214. This increase in weight to the back of golf club head 104 at the low position on the club head 104 lowers the center of gravity of the club head 104, thus generally allowing the golf club head 104 to propel a golf ball with a higher trajectory. In addition, wall 230 and/or feel altering elements 232 and 234 may be used to increase the support of bridge member 224 and may prevent or reduce deformation of bridge member 224 upon contact with a golf ball. This added support may tend to increase the distance that a golf ball travels after impact with the club head 104.

Figure 5:
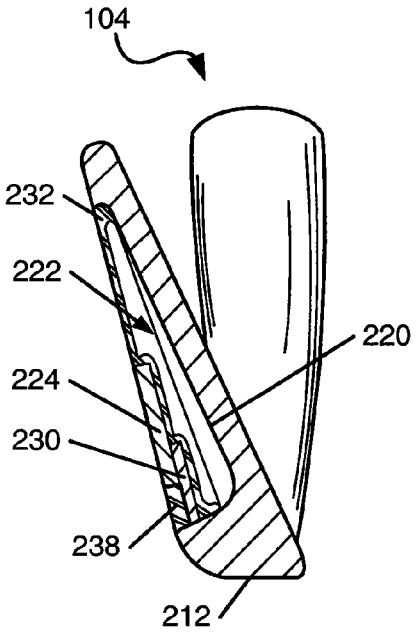
FIGS. 5 and 5A illustrate cross-sectional views of additional example golf club heads in accordance with the present invention.
Figure 5A:
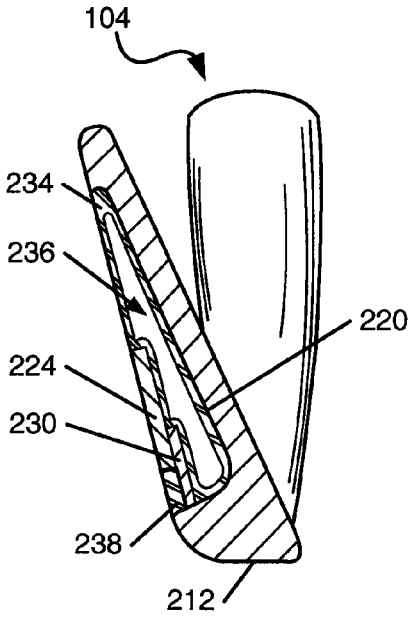

Other features of a club head 104 also may be used to control and/or vary the position of the center of gravity of a club head 104. For example, with reference to FIGS. 5 and 5A, the position of the center of gravity of a golf club head 104 also may be modified by placing a material 238 in the second rear cavity 228 to at least partially fill the second rear cavity 228. The material 238 placed in the second rear cavity 228 may include an epoxy and/or a high density material, such as a material made from or including lead, tungsten, a lead-containing alloy or material, a tungsten-containing alloy or material or combinations thereof. In addition or alternatively, if desired, the material 238 placed in the second rear cavity 228 may comprise a vibration damping material to further impact feel characteristics of the club head structure 104. By placing a weighted material 238 in the second rear cavity 228, the position of a center of gravity of the golf club head 104 with respect to the striking face 214 may be varied and controlled. In particular, the center of gravity of golf club head 104 relative to the striking face 214 may be lowered (e.g., when the second rear cavity 228 is located at the lower back portion of the club head 104 as shown in FIGS. 5 and 5A), thereby assisting the golfer in obtaining additional loft of the golf shot. The material 238 may be fit into the recess 228 and held therein in any desired manner without departing from the invention, such as via adhesives, mechanical connectors, friction fits, fusing techniques, etc. Alternatively, if desired, the material 238 and/or portions thereof may be integrally formed as a unitary one piece construction with any one or more of bridge member 224, wall member 230, feel altering elements 232 and/or 234, or the club head 104.

FIGS. 6 through 9 illustrate another example golf club head structure 600 in accordance with at least some examples of this invention (e.g., for use in the shorter irons, such as six irons through various wedges, although the various features may be used in any desired iron or hybrid club structure). In this example structure 600, the golf club head 600 includes a body member 602 that includes a heel portion 604 and a toe portion 606. The heel portion 604 is attached to or extends from a hosel 608 for connecting to a shaft 610, as generally described above in conjunction with FIGS. 1 and 2. The body member 602 also includes a top portion 612 and a sole portion 614. A striking face 616 is provided in the area between the top portion 612, the sole portion 614, the toe portion 606, and the heel portion 604. The striking face 616 provides a contact area for engaging and propelling a golf ball, e.g., in the manner described above. The striking face 616 may include grooves 618, e.g., horizontal grooves, for the removal of water and grass from the striking face 616 during a ball strike. The body 602 of the golf club head 600 may be constructed from one or more pieces of various materials, such as steel, titanium, aluminum, tungsten, graphite, polymers, or composites or combinations thereof as described above in conjunction with FIGS. 1-5A, and the golf club head 600 may be included in a golf club structure in any desired manner (e.g., attached to the shaft 610), including the various manners described above in conjunction with FIGS. 1-5A.

Figure 7A:
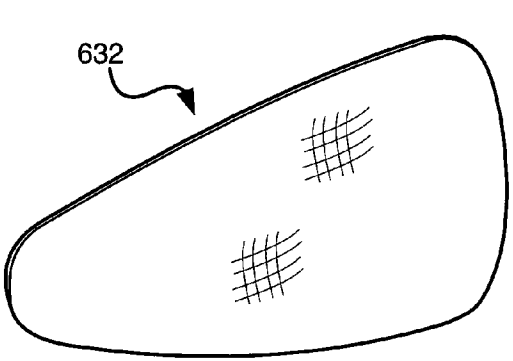
FIG. 7A illustrates an example feel altering element that may be included in a golf club head structure in accordance with the present invention.
Figure 6:
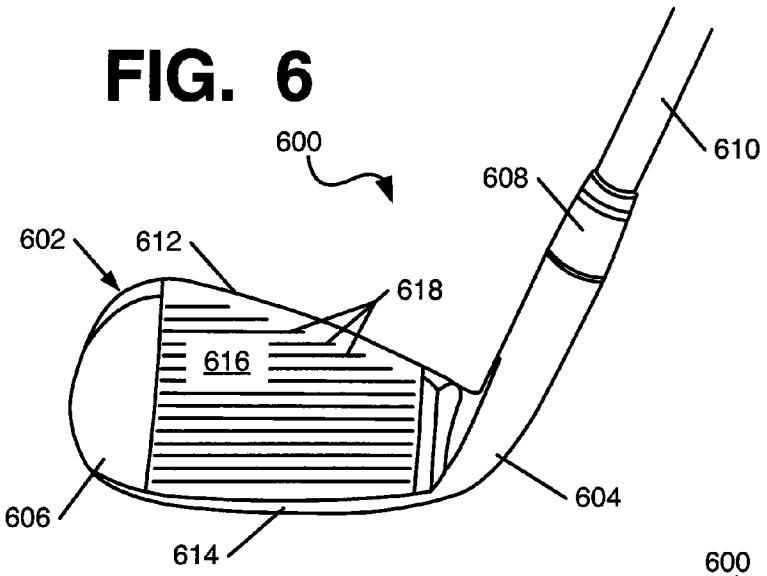
FIG. 6 illustrates a front view of another example golf club head in accordance with the present invention.
Figure 7:
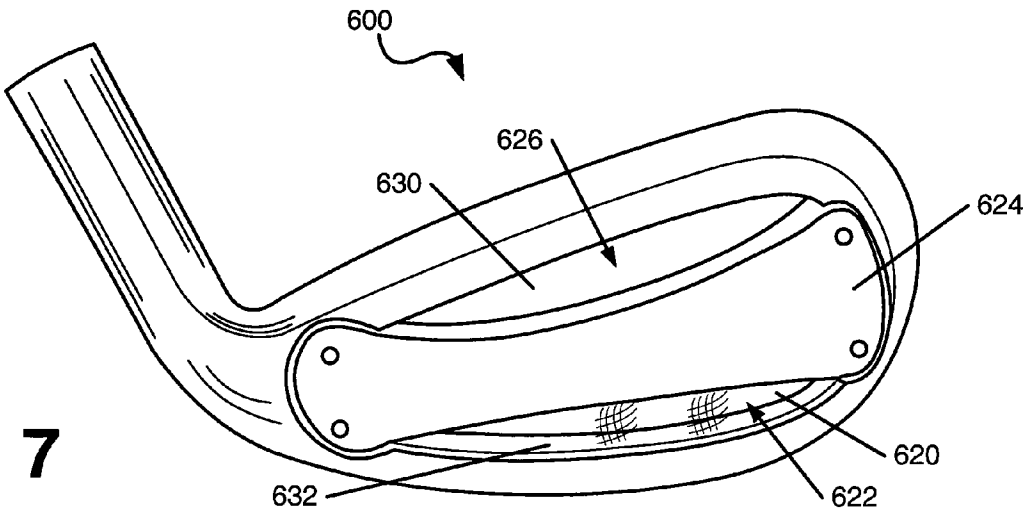
FIG. 7 illustrates a rear view of another example golf club head in accordance with the present invention.

FIG. 7 illustrates a rear view of a golf club head 600 according to at least some examples of this invention. Golf club head 600 of this example structure includes a rear face 620 positioned opposite the striking face 616. The body member 602 further forms and defines a first rear cavity 622, which in this example club head structure 600 has a large opening. A bridge member 624 extends across the first rear cavity 622, e.g., in a direction from and/or connecting the heel portion 604 to the toe portion 606. Bridge member 624 may extend across the first rear cavity 622 and connect to various other locations on the golf club head 600, as shown, for example, in U.S. Pat. No. 6,450,897 to John T. Stites, et al. The bridge member 624 may be constructed in various shapes, as described above in conjunction with FIGS. 1-5A, and it may be formed with and/or connected to the remainder of the golf club head structure 600 in any desired manner, including the manners described above in conjunction with FIGS. 1-5A.

Figure 8:
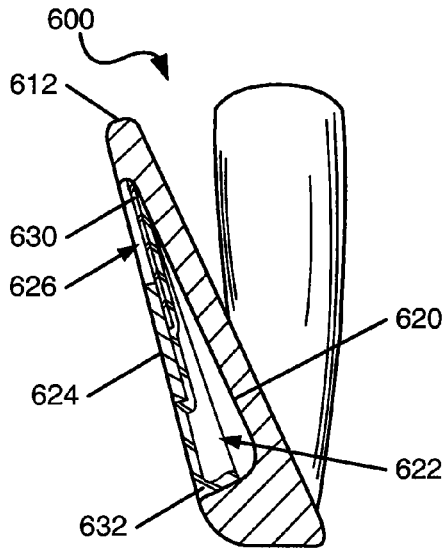
FIG. 8 illustrates a cross-sectional view of another example golf club head in accordance with the present invention.
Figure 9:
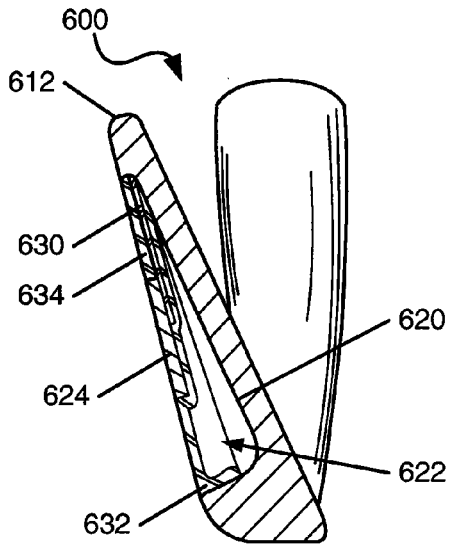
FIG. 9 illustrates a cross-sectional view of another example golf club head in accordance with the present invention.

A second rear cavity 626 is illustrated in FIG. 7, in this example structure 600 located above the bridge member 624. FIG. 8 provides a cross-sectional view of the example golf club head 600 showing this additional rear cavity 626. As shown in FIG. 8, a wall 630 extends from the top portion 612 of the club head 600 to the bridge member 624. The wall 630 creates and defines, at least in part, the second rear cavity 626, which includes an opening positioned above bridge member 624. As shown in FIG. 8, the wall 630 may include a front surface (facing outside the club head structure 600 toward second rear cavity 626), a back surface (facing inside the club head structure 600 toward the first rear cavity 622), a top surface, and a bottom surface. A space may exist between the back surface of wall 630 and the rear face 620 of the golf club head 600.

Wall 630 may be integrally formed with the club head structure 600 and/or with the bridge member 624, if desired, to provide additional support and stiffness to bridge member 624. The wall 630 may be linear, curved, or otherwise shaped, e.g., optionally depending upon the shape of bridge member 624, the shape of the club head 600, and/or desired aesthetics. Like the club head 600, the wall 630 and/or the bridge member 624 may be made from a wide variety of materials, such as stainless steel, titanium, graphite, plastic, or a composite material or combinations thereof, and the club head 600, wall 630, and bridge member 624 may be made from the same or different materials without departing from this invention. The additional support and stiffness to bridge member 624 provided by wall 630, if any, may help prevent or reduce deformation of bridge member 624 upon contact with a golf ball during a swing. In addition, if desired, the wall 630 may provide at least some vibration damping effect upon impact of striking face 616 with a golf ball.

In at least some example structures, if desired, the front surface and/or the top surface of wall 630 may be secured to the bridge member 624 and/or top portion 612 of the club head 600, e.g., using an adhesive, mechanical connectors, fusing techniques, etc. Those skilled in the art will recognize that numerous ways exist to attach the wall 630 to the remainder of the club head structure 600, and any of these various ways may be used without departing from the present invention. Also, if desired, the wall 630 may be made of multiple pieces that extend continuously or discontinuously, e.g., along the bridge member 624.

Bridge member 624 increases the weight of the back of the golf club head 600 relative to its striking face 616. This increase in weight toward the rear of golf club head 600 alters the center of gravity of golf club head 600. By moving the center of gravity higher and toward the rear of the golf club head, a golf ball generally may be propelled with a lower and/or more controlled trajectory.

The shape, weight distribution, and/or location of bridge member 624 also may influence the location of the center of gravity of golf club head 600. For example, on the shorter iron clubs (e.g., six iron through the pitching wedge or other wedges), it may be desirable for at least some golfers to have a center of gravity higher than that provided on the longer iron and/or hybrid clubs. On the shorter iron clubs, a higher center of gravity may enable at least some golfers to have greater control over the flight of the golf ball. Therefore, the bridge member 624 for shorter iron clubs may be positioned somewhat higher on the rear of the golf club head body 600 as compared to a bridge member on longer iron or hybrid type clubs (e.g., as seen by a comparison of FIGS. 3-4 with FIGS. 7-8).

FIGS. 7 and 8 further illustrate inclusion of a feel altering element 632 as part of the club head structure 600. FIG. 7A illustrates an example of the feel altering element 632 of this structure 600 in more detail. As shown, the feel altering element 632 of this illustrated example is a thin plate or shell member that fits in the first recess cavity 622, between the bridge member 624 and the rear surface 620 of the club head structure 600 and essentially covers the entire cavity 622. The feel altering element 632 may be made from any desired materials without departing from this invention, including, for example, the various materials and in the various constructions described above for elements 232 and/or 234. The feel altering element 632 may be relatively stiff so as to at least generally hold its own shape, or it may be rather flexible and/or pliable to enable it to at least generally take the shape of the recess into which it is fit. The inclusion of the feel altering element 632 may be used to control or change various feel aspects of the club head 600, such as the sound emitted by the club head 600 during contact with a golf ball, the swing weight and/or center of gravity characteristics of the club head 600, vibrational response of the club head 600 during contact with a golf ball (e.g., to reduce or eliminate a "stinging" or other vibrational sensation to the user's hands, etc.), and the like. The material of the feel altering element, its positioning, its thickness, its size, and the like may be used to "tune" the golf club's feel to a feel desired by club designers and/or individual users. Additionally, if desired, the feel altering element 632 may be made from multiple pieces and/or it need not completely fill the rear cavity 622.

FIGS. 7, 7A, and 8 illustrate the feel altering element 632 as a single piece, thin shell or plate material that fits into the first recess cavity 622. Any manner of holding the feel altering element 632 in place may be used without departing from this invention, such as adhesives or cements; edges or projections fitting into corresponding grooves or recesses on the club head structure 104 (e.g., on the perimeter of the recess cavity 222, in the rear face 220, etc.) or vice versa; friction fits; a spring-like or expansion fit; etc. Also, feel altering elements like those illustrated and described above in conjunction with FIGS. 4A and 5A (with chambers, including fluid-filled chambers and/or pressurized chambers) may be used in the club head structure of FIGS. 6-8 without departing from the invention.

Raising the center of gravity of golf club head 600 also may be accomplished, at least in part, through the use of the wall 630. Wall 630 may be used to increase the weight on the back of the golf club head 600 relative to the striking face 616. This increase in weight to the high back portion of golf club head 600 raises the center of gravity of golf club head 600, thereby better allowing the golf club head 600 to propel a golf ball with a somewhat lower and more controlled trajectory.

Other features also may be used to control and vary the location of the center of gravity of a golf club head 600 without departing from the invention. For example, with reference to FIG. 9, if desired, the position of the center of gravity of a golf club head 600 also may be modified and controlled by placing a material 634 in the second rear cavity 626 in order to at least partially fill the second rear cavity 626. The material 634 provided in the second rear cavity 626 may be any desired material, including, for example, an epoxy and/or a high density material made from or including materials such as lead, tungsten, a lead-containing alloy or material, a tungsten-containing alloy or material, or combinations thereof. In addition, if desired, the material 634 provided in the second rear cavity 626 may include a vibration damping material. By providing material 634 in the second rear cavity 626, the position of the center of gravity of the golf club head 600 with respect to the striking face 616 may be further varied and controlled. In particular, the center of gravity of golf club head 600 relative to the striking face 616 may be raised in this example structure, thereby providing the golf club head 600 with a lower initial loft when impacting a golf ball.

A feel altering element in accordance with at least some examples of this invention may be used in conjunction with a wide variety of other cavity back or other golf club head structures without departing from this invention. Various additional example golf club head structures with feel altering elements and/or removable and/or customizable weighting features are described in more detail below in conjunction with FIGS. 10A through 15. FIGS. 10A through 15 generally illustrate features of the rear side of a club head structure. Those skilled in the art will recognize and appreciate that golf club head structures may include any desired front structure or configuration without departing from this invention. While recognizing this potential variability, the illustrated examples describe various club head structures with a front face, for example of the types illustrated in FIGS. 2 and 6.

Figure 10A:
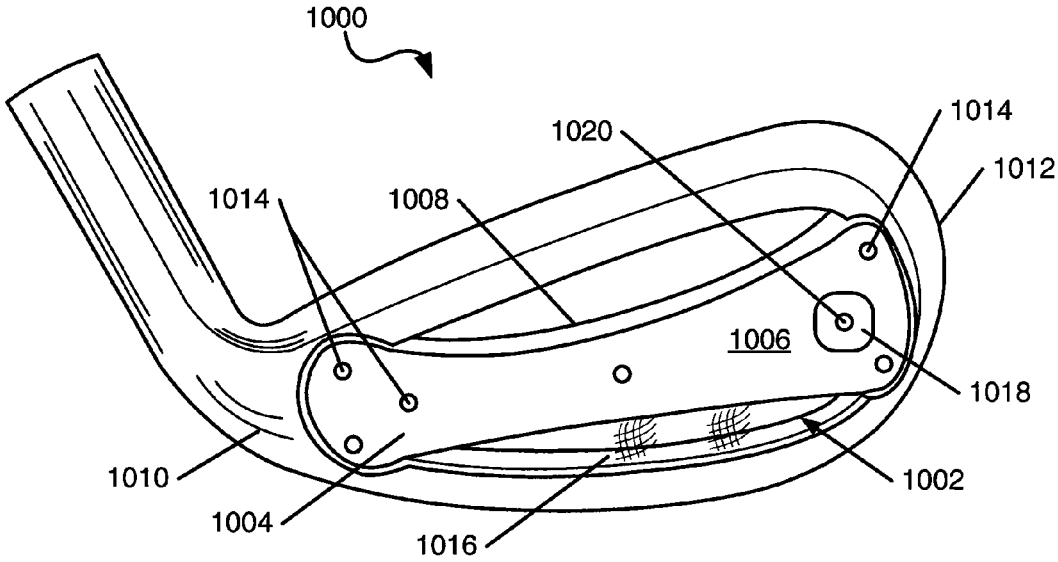
FIGS. 10A through 10C illustrate rear views of an example golf club head in accordance with the present invention with a weight chip attached to the bridge member at various different fixed locations.
Figure 10B:
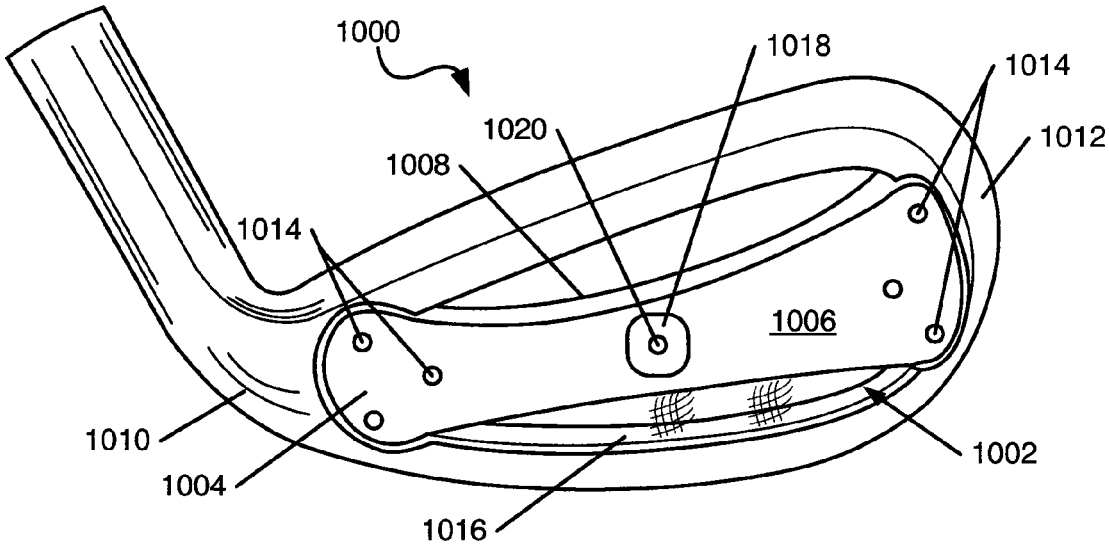
Figure 10C:
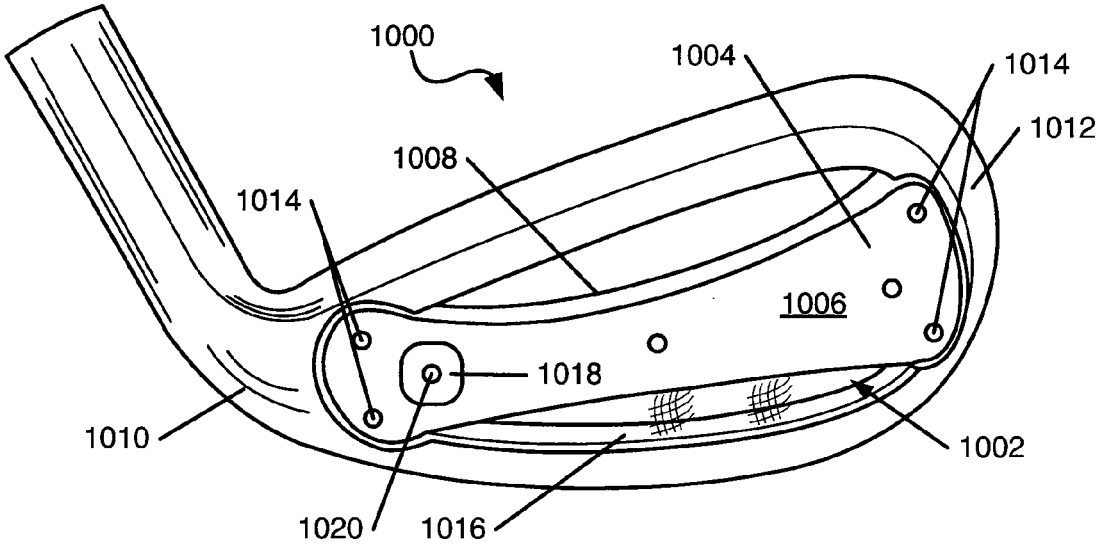

FIGS. 10A through 10C illustrate rear views of a golf club head 1000 in accordance with at least some examples of this invention. Golf club head 1000 of this example structure includes a rear cavity 1002 positioned opposite the striking face. A bridge member 1004 having a front surface 1006 and a back surface 1008 extends across the rear cavity 1002, in a direction of and optionally connected with or otherwise extending from the heel portion 1010 to the toe portion 1012 of the club head 1000. Bridge member 1004 also may extend across the rear cavity 1002 and/or be connected at various other locations on the golf club head 1000 as shown, for example, in U.S. Pat. No. 6,450,897. The bridge member 1004 may be constructed in various shapes, as described above in conjunction with FIGS. 1-5A, and it may be formed with and/or connected to the remainder of the golf club head structure 1000 in any desired manner, including the various manners described above in conjunction with FIGS. 1-5A.

If desired, the bridge member 1004 may be formed with the golf club head 1000 in a single casting thereby making the bridge member 1004 integral with the golf club head 1000. As an alternative, if desired, bridge member 1004 may be connected to the toe portion 1012 and heel portion 1010 of the club head structure 1000 (or other portions) using mechanical connectors, such as rivets or screws 1014, cements or adhesives, fusion techniques (such as welding, soldering, or brazing), and the like. Those skilled in the art will recognize, of course, that bridge member 1004 may be connected to the toe portion 1012 and/or the heel portion 1010 using fewer or additional connection points and/or through numerous other connection techniques and means without departing from the present invention.

As further shown in FIGS. 10A through 10C, the club head structure 1000 includes a feel altering element 1016, e.g., provided between the bridge member 1004 and the rear face 1002 of the club head structure 1000. The feel altering element 1016 may take on the various forms and be connected with the remainder of the club head structure 1000 in any desired manner, including the various forms and manners described above in conjunction with FIGS. 1-9 for elements 232, 234, and/or 632.

In accordance with at least some examples of this invention, bridge member 1004 may have one or more weights 1018 attached to it, e.g., to the front surface 1006 of bridge member 1004, e.g., at various fixed locations as shown in FIGS. 10A through 10C. As more specific examples, FIG. 10A illustrates weight 1018 attached to the front surface 1006 of bridge member 1004 closer to toe portion 1012 of golf club head 1000. As alternatives, weight 1018 may be attached to the front surface 1006 in the center of the bridge member 1004 (FIG. 10B) or closer to the heel portion 1010 of golf club head 1000 (FIG. 10C). As still additional examples, if desired, one or more weights 1018 may be attached to various locations on the back surface 1008 of bridge member 1004 and/or fit into slots, grooves, or other receptacles formed in the bridge member 1004 without departing from this invention.

Those skilled in the art will recognize, of course, that weight 1018 may be made of various shapes and/or sizes, such as rectangular, oval, triangular, trapezoidal, square, elliptical, or other symmetrical or asymmetrical shapes. In the example illustrated in FIGS. 10A through 10C, weight 1018 is shown as generally a rectangular or square weight chip. The weight 1018 may be made from any desired material, including one or more materials selected from the group of stainless steel, carbon steel, titanium, aluminum, tungsten, graphite, lead, polymers, plastics, or composites or combinations thereof. In addition, if desired, weight 1018 may be freely removable from the club head structure 1000 and/or interchangeable with a plurality of alternative weights having different sizes, shapes, and/or masses as compared to weight 1018. Such features may be used to further control and/or vary the center or gravity, weighting characteristics, and/or feel characteristics of the golf club head 1000.

Weight 1018 may be connected to the front surface 1006 or back surface 1008 of bridge member 1004, for example, using a rivet, set screw, or locking pin 1020. Those skilled in the art will recognize, of course, that weight 1018 may be attached to and/or locked into position onto bridge member 1004 in any desired manner without departing from this invention, including in a wide variety of ways utilizing connection hardware, such as locking screws, clamps, clips, clasps, etc., and/or using adhesives or fusion techniques. Those skilled in the art also will realize that more than one weight 1018 may be attached to bridge member 1004 at various different locations without departing from this invention.

In the same manner as generally described above in connection with FIGS. 1-9, the weight distribution of a golf club head 1000 and/or the location of the center of mass thereof may be controlled through the use of the bridge member 1004 and/or weight 1018 (and/or other features of the club head 1000, such as the feel altering element 1016, walls, etc.) in accordance with this illustrated example. As a more specific example, bridge member 1004 and/or weight 1018 may be used to increase the weight of the back of the golf club head 1000 relative to its striking face. This increase in weight toward the rear of golf club head 1000 alters the center of gravity of golf club head 1000. By moving the center of gravity lower and toward the rear of the golf club head 1000, a golf shot will tend to have an increased loft upon impact with a golf ball. By moving the center of gravity higher and toward the rear of the golf club head 1000, a golf shot will tend to have a decreased loft and/or a user will be provided increased control over the golf shot upon impact with a golf club.

With reference to FIGS. 10A through 10C, weight 1018 may be moved to allow user, designer, and/or club fitter adjustment and control of the position of the center of gravity of club head 1000. By moving weight 1018 to different locations as shown in FIGS. 10A through 10C, the position of the center of gravity of the golf club head 1000 with respect to the striking face may be varied and controlled. In particular, moving the center of gravity of golf club head 1000 relative to the striking face may help improve the ball flight of a golfer having a tendency to hit a golf ball toward the left or right of the fairway and/or help prevent the golfer from hitting the ball too far to the left or right of the fairway. For example, FIG. 10A shows weight 1018 arranged toward the toe portion 1012 of golf club head 1000. This arrangement will tend to cause the golf ball to move toward the right of a fairway (for a right-handed golfer) because the toe portion 1012 of the club head 1000 will tend to lag behind somewhat during the swing, thereby leaving the club head face somewhat open at impact with the golf ball (as compared to the same swing without the weight 1018 at this position). Therefore, in the position of FIG. 10A, the club head 1000 will have a fade or slice bias and/or may be useful to assist golfers with a tendency to draw or hook the ball. In FIG. 10C, the weight 1018 is located toward the heel portion 1010 of the golf club head 1000, which will tend to cause the golf ball to move toward the left of the fairway (for a right-handed golfer) because the toe portion 1012 of the club head will tend to be in front of the heel somewhat during the swing, thereby leaving the club head face somewhat closed at impact with the golf ball (as compared with the same swing without weight 1018 at this position). Therefore, in the position of FIG. 10C, the club head 1000 will have a draw or hook bias and/or may be useful to assist golfers with a tendency to fade or slice the ball. In FIG. 10B, the weight 1018 is attached to front surface 1006 near the center of bridge member 1004, which will tend to produce a balanced or unbiased shot directing the golf ball along a straight route toward the middle of the fairway (assuming square contact is made during the swing).

Figure 11A:
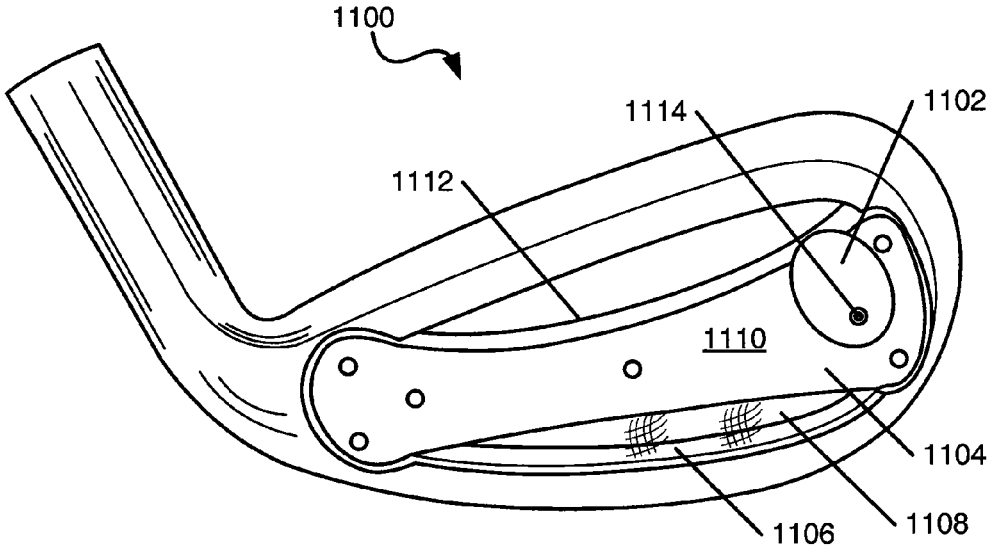
FIGS. 11A through 11C illustrate rear views of another example golf club head in accordance with the present invention with an elliptical shaped weight member attached to the bridge member at various different fixed locations.
Figure 11B:
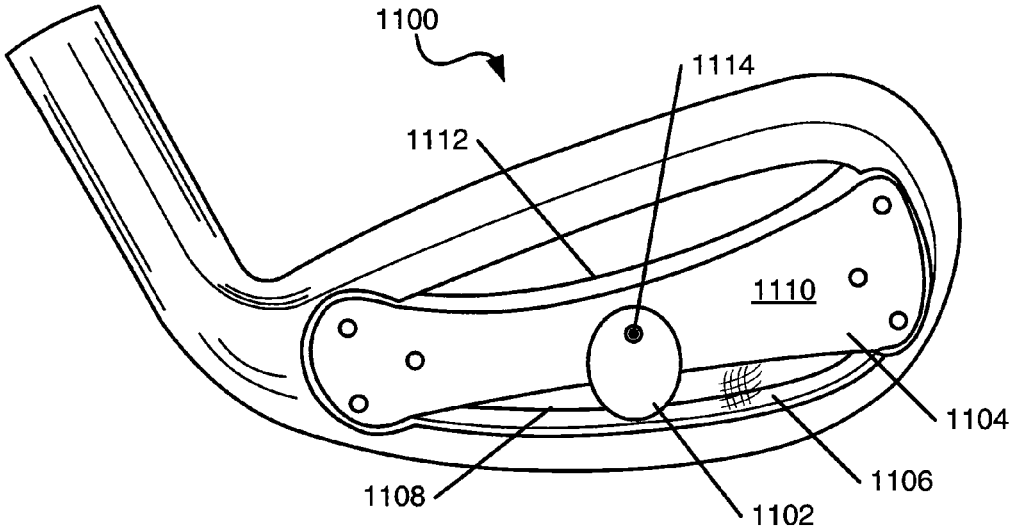
Figure 11C:
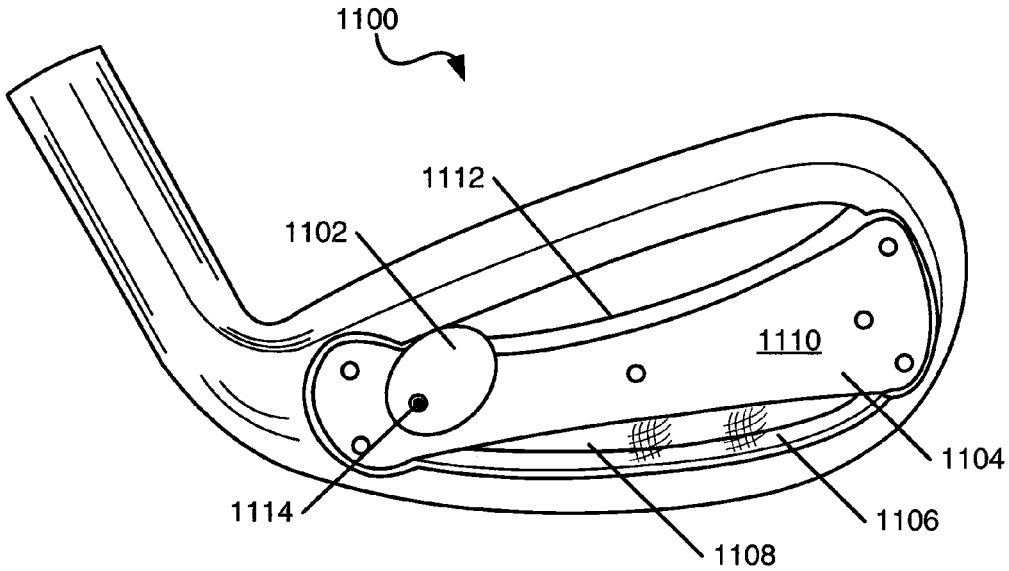

FIGS. 11A through 11C illustrate another example of a golf club head 1100 including a weight member 1102 as part of the club head structure 1100. In this example structure 1100, the weight member 1102 has an elliptical shape. This elliptical shaped weight 1102 may be located in various fixed positions on bridge member 1104, as shown by a comparison of its location in FIGS. 11A through 11C. Additionally, the elliptical shaped weight 1102 may be rotated to further vary and control the position of the center of gravity of golf club head 1100 (e.g., control its location in a second direction, such as in a vertical direction) with respect to the striking face. As discussed above, the position of the center of gravity of a golf club head in the generally vertical direction influences whether a golf shot exhibits a high, arching trajectory or a lower, flatter trajectory. Accordingly, rotating and positioning the elliptical shaped weight 1102 above its point of engagement with the bridge member 1104 will tend to raise the center of gravity of golf club head 1100 somewhat. As noted above, raising the center of gravity of a golf club head 1100 helps the golfer propel a golf ball with a lower and more controlled trajectory. Alternatively, rotating and positioning the elliptical shaped weight 1102 below its point of engagement with the bridge member 1104 will tend to lower the center of gravity of golf club head 1100, to thereby better allow a golfer to propel a golf ball with additional loft.

As further shown in FIGS. 11A through 11C, the club head structure 1100 includes a feel altering element 1106, e.g., provided between the bridge member 1104 and the rear face 1108 of the club head structure 1100. The feel altering element 1106 may take on the various forms and/or be connected with the remainder of the club head structure 1100 in any desired manner, including the various forms and manners described above in conjunction with FIGS. 1-9 for elements 232, 234, and/or 632.

The elliptical shaped weight 1102 may be connected to the front surface 1110 and/or back surface 1112 of bridge member 1104 in any desired manner, such as using a set screw or locking pin 1114, a locking screw, clamps, clasps, clips, or other mechanical connectors. Those skilled in the art will understand, of course, that the weight 1102 may be attached to the club head 1100 in a wide variety of different manners, and that it may have a wide variety of different shapes, compositions, structures, and the like without departing from this invention. Additionally, if desired, multiple weight members 1102, e.g., elliptically or otherwise shaped, may be attached to the club head 1100 without departing from this invention.

FIGS. 12A through 12D illustrate still another example of a club head structure 1200 in accordance with this invention. As shown in FIGS. 12A through 12D, the golf club head 1200 includes a rear wall 1202 and defines a rear cavity positioned opposite the ball-striking face. A bridge member 1204 having a front surface 1206 and a back surface 1208 extends across the rear cavity in a direction of and/or connecting between the heel portion 1210 and the toe portion 1212 of the club head 1200 (although bridge member 1204 connections at other locations also are possible as described above and illustrated, for example, in U.S. Pat. No. 6,450,897). Bridge member 1204 may be made in various shapes, various widths and/or thicknesses, and/or with uniform or non-uniform width and/or thickness over its length, as described above in conjunction with FIGS. 1-5A. The bridge member 1204 also may be formed with and/or connected to the remainder of the golf club head structure 1200 in any desired manner, including the manners described above in conjunction with FIGS. 1-11C.

If desired, in at least some examples of this invention, the bridge member 1204 may be formed with the golf club head 1200 in a single casting thereby making the bridge member 1204 integral with the golf club head 1200. As an alternative, bridge member 1204 may be connected to the toe portion 1212 and/or heel portion 1210 (or other portions of the club head structure 1200) using set screws 1214. Those skilled in the art will recognize, of course, that bridge member 1204 may be connected to the toe portion 1212 and/or the heel portion 1210 (or other portions of the club head structure 1200) using fewer or additional connection points and/or through numerous other connection means or systems without departing from the present invention, as generally described above.

Figure 12A:
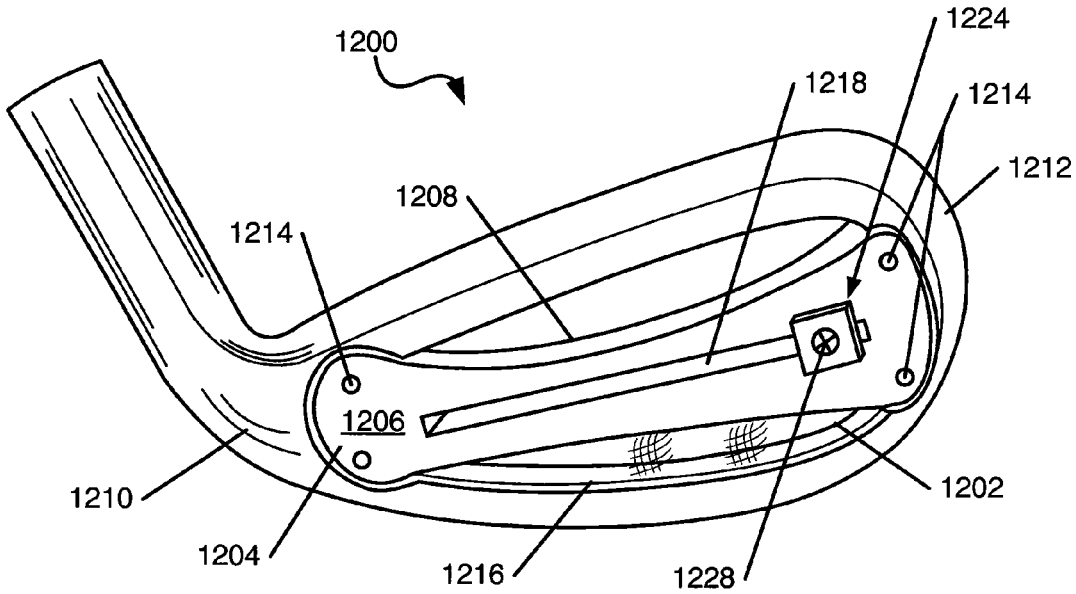
FIGS. 12A through 12C illustrate rear views of another example golf club head in accordance with the present invention with a rail and weight assembly located at various different positions on the bridge member.
Figure 12B:
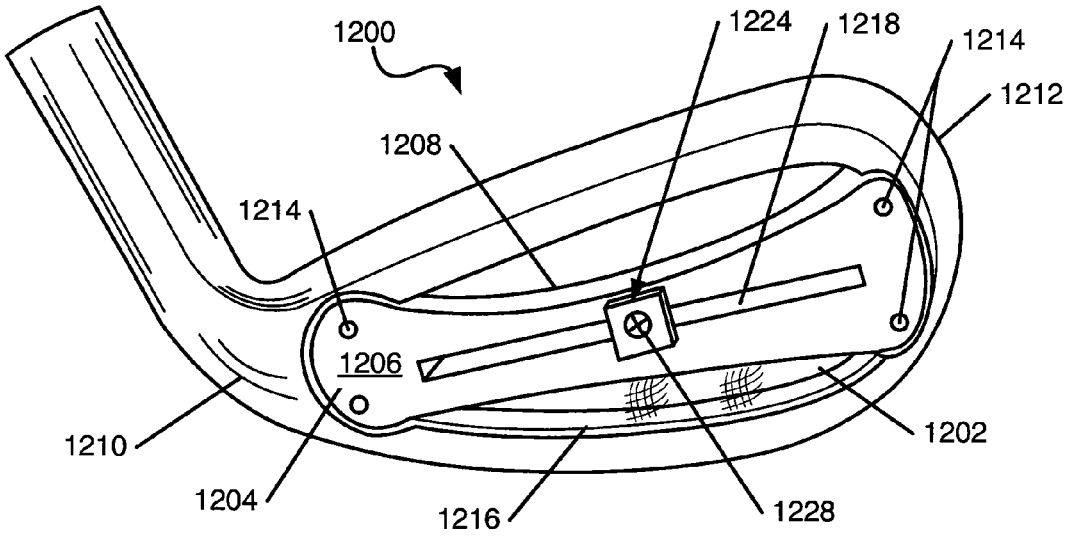
Figure 12C:
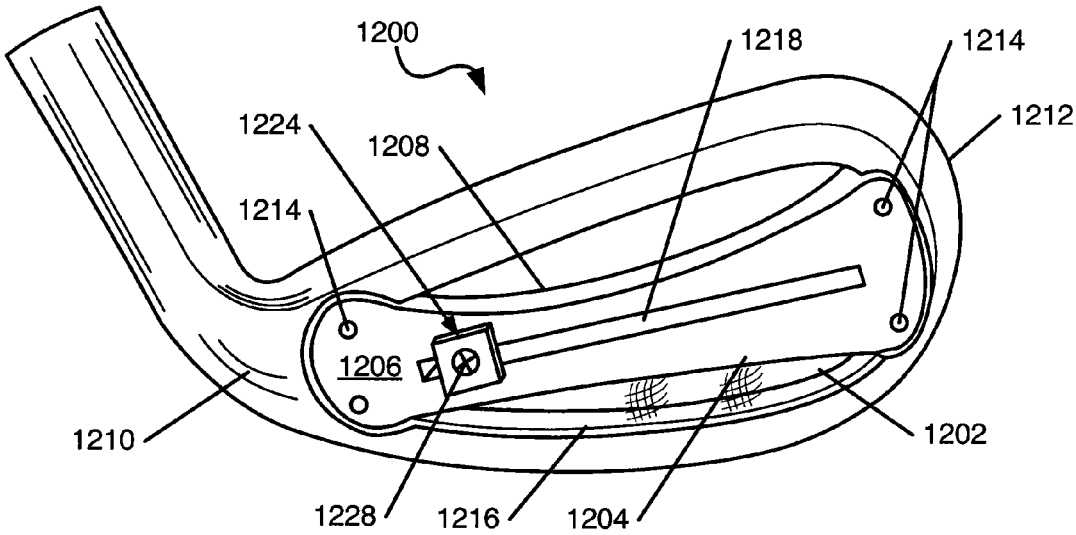

As further shown in FIGS. 12A through 12C, the club head structure 1200 includes a feel altering element 1216, e.g., provided between the bridge member 1204 and the rear face 1202 of the club head structure 1200. The feel altering element 1216 may take on the various forms and/or be connected with the remainder of the club head structure 1200 in any desired manner, including the various forms and manners described above in conjunction with FIGS. 1-9 for elements 232, 234, and/or 632.

Figure 12D:
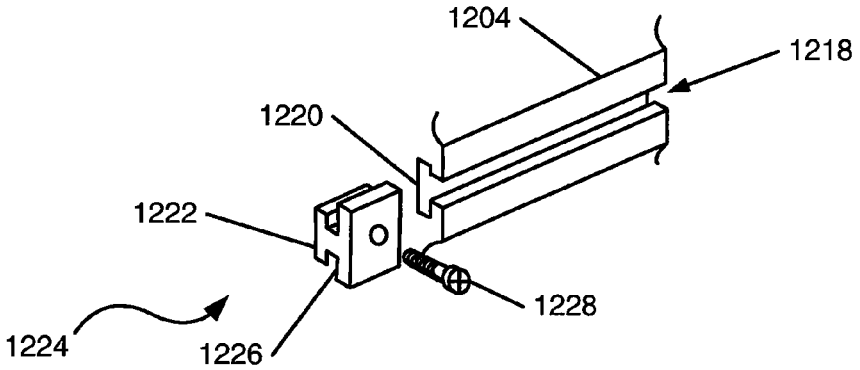
FIG. 12D provides a more detailed illustration of the example rail and weight assembly shown in FIGS. 12A through 12C.

In this illustrated structure 1200, bridge member 1204 includes a rail 1218 formed in its front surface 1206. One example of a structure for rail 1218 is illustrated in FIG. 12D, which shows that the rail 1218 includes a channel 1220 for engaging a first surface 1222 of a weight 1224. A second surface 1226 of weight 1224 may slide along the outside of rail 1218 allowing a golfer or club fitter to lock the weight 1224 into a selected and desired place, e.g., with a set screw 1228. If desired, the set screw 1228 may fit into one of plural recesses or openings provided in channel 1220, to help assure that the weight 1224 remains locked in place. A golfer utilizing the golf club head 1200 of FIGS. 12A through 12D may freely position the weight 1224 at various locations along rail 1218. For example, as shown in FIG. 12A, the weight 1224 may be located on rail 1218 in a location close to the toe portion 1212 of golf club head 1200 (e.g., as an aid for golfers who tend to hook the ball to more readily hit the ball toward the center of the fairway and/or to provide a fade bias to the club head 1200). As an alternative, as shown in FIG. 12B, weight 1224 may be located near the center of bridge member 1204, e.g., for use by golfers who tend to hit the ball straight or who do not have a clearly established or biased ball flight tendency. As still another alternative, as shown in FIG. 12C, the weight 1224 also may be located on rail 1218 at a location closer to the heel portion 1210 of the golf club head 1200 (e.g., as an aid for golfers who tend to slice the ball to more readily hit the ball toward the center of the fairway and/or to provide a draw bias to the club head 1200). By moving weight 1224 along rail 1218 a golfer can selectively modify the position of the center of gravity of head 1200 in a first direction with respect to the striking face, e.g., to conform to a particular playing style and/or preference of the golfer, to help correct consistently undesired ball flight, etc. Accordingly, the golfer may modify the typical flight path of the golf ball by repositioning the center of gravity of head 1200 with respect to club head's striking face.

Figure 13A:
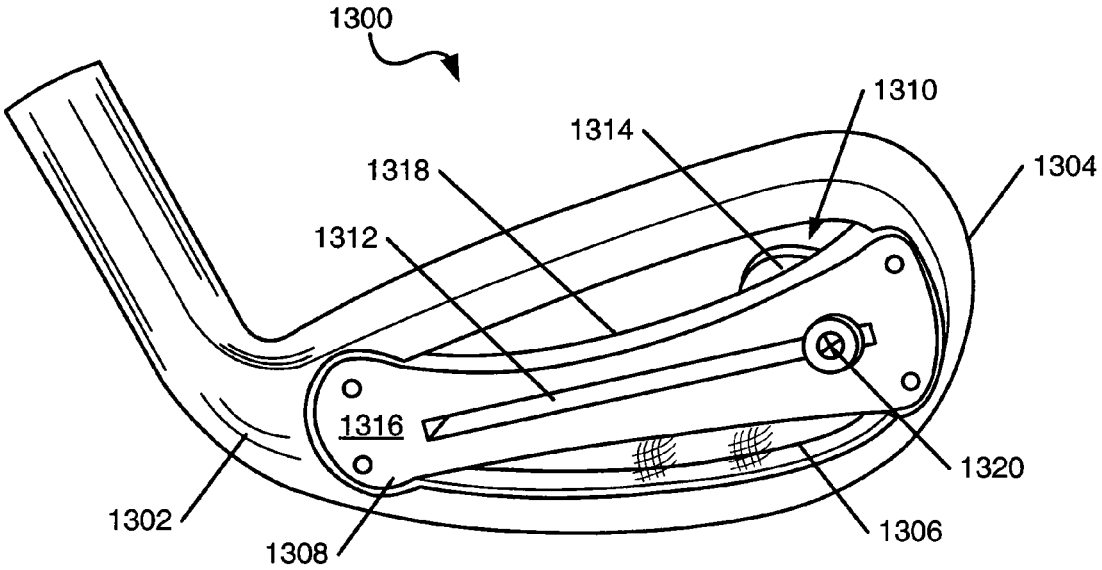
FIGS. 13A through 13C illustrate rear views of another example golf club head in accordance with the present invention with a rail integral to a bridge member and an elliptical shaped weight attached to the rail at various different locations along the rail.
Figure 13B:
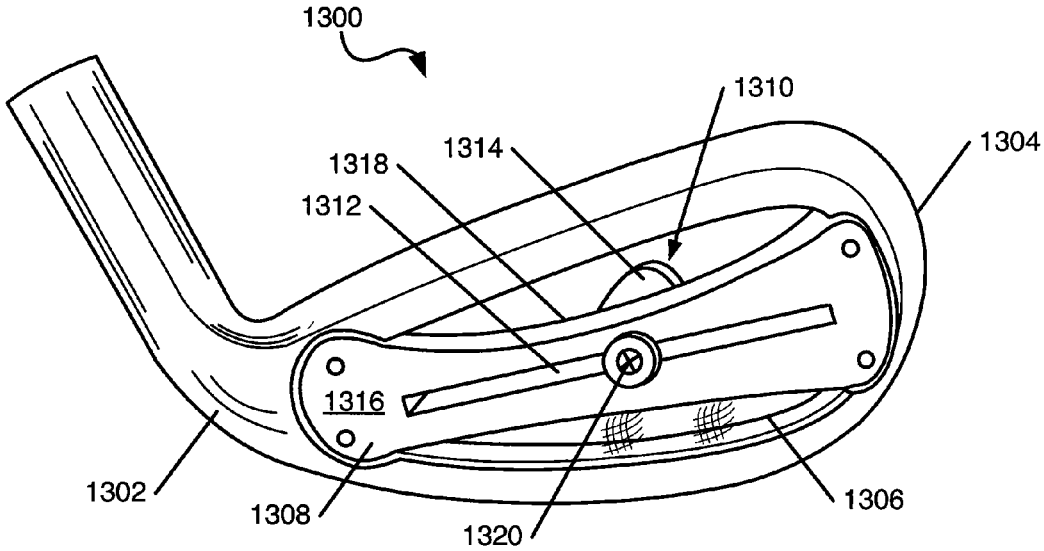
Figure 13C:
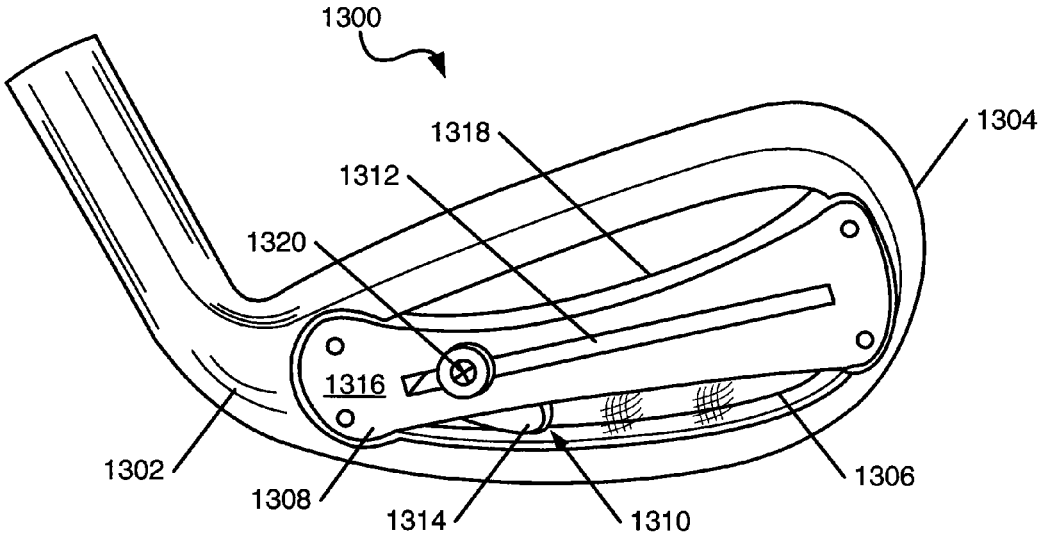

FIGS. 13A through 13C illustrate another example club head structure 1300 in accordance with some examples of this invention. As shown in FIG. 13A, a golf club head 1300 according to this example structure includes a heel portion 1302, a toe portion 1304, and a striking face that provides a contact area for engaging a golf ball. The golf club head 1300 also includes a rear wall 1306 and defines a rear cavity opposite the striking face. A bridge member 1308 extends across the rear cavity in a direction between the toe portion 1304 and the heel portion 1302. The golf club head 1300 further includes a weight positioning assembly 1310 integral to bridge member 1308. The weight positioning assembly 1310 includes a rail or groove 1312 and a weight 1314 movably connected to the rail 1312. The rail 1312 may extend from the front surface 1316 of bridge member 1308 through to its back surface 1318, or it may extend only partially through the thickness of the bridge member 1308. The weight 1314 is movable along rail 1312 to vary a position of a center of gravity of the golf club head 1300 in a first direction with respect to the striking face (e.g., in the generally horizontal direction and/or along the direction of the rail 1312), and it may be locked in place (e.g., via a screw 1320, locking pin, or other securing element) to hold it in the desired position along the rail 1312.

The weight 1314 illustrated in the example of FIGS. 13A through 13C has an elliptical shape. The elliptical shaped weight 1314 may be located in various positions on bridge member 1308 and held in place, for example, using a washer and set screw 1320 combination (or other desired securing mechanism or structure). The weight 1314 also may be rotated to further vary the position of the center of gravity of golf club head 1300 in a second direction with respect to striking face, e.g., to generally vary the location of the center of gravity in the vertical direction, as described above in conjunction with FIGS. 11A through 11C.

As described with respect to various other example structures, the position of the center of gravity of golf club head 1300 influences whether a golf shot exhibits a high, arching trajectory or a low, flatter trajectory. Accordingly, rotating and positioning elliptical shaped weight 1314 above the point of engagement with the bridge member 1308 raises the center of gravity of golf club head 1300 somewhat. Raising the center of gravity of golf club head 1300 generally allows a golfer to propel a golf ball with a lower and more controlled trajectory. Alternatively, rotating and positioning elliptical shaped weight 1314 below the point of engagement with the bridge member 1308 lowers the center of gravity of golf club head 1300 somewhat, thereby generally allowing a golfer to propel a golf ball higher, e.g., with additional loft. By moving and rotating elliptical shaped weight 1314 in two or three dimensions, a golfer or a club fitter has great flexibility to position the center of gravity of the head 1300 with respect to the striking face, as needed, e.g., to bias the club to induce specific shot shapes (e.g., fades, draws, etc.), to help correct ball path flight issues that occur due to certain swing faults, etc.

More specific examples of weight and center of gravity adjustment are illustrated by comparison of FIGS. 13A through 13C. As shown in FIG. 13A, elliptical shaped weight 1314 is located on bridge member 1308 near the toe portion 1304 of golf club head 1300. In addition, the elliptical shaped weight 1314 is rotated into a position above the point of engagement of the weight 1314 with the bridge member 1308 and/or above the point of engagement between the club head 1300 and a golf ball, as indicated by the appearance of the elliptical portion of the weight 1314 at an elevated position, partially above bridge member 1308 in FIG. 13A. This placement of elliptical shaped weight 1314 will tend to raise and shift the center of gravity of golf club head 1300 rearward and toward the toe portion 1304 of the golf club head 1300. A golf ball hit with this particular golf club head configuration will tend to propel the golf ball with a lower and more controlled trajectory toward the right of the fairway for a right-handed golfer (e.g., to help correct a hook, to provide a fade bias for the club, etc.).

As another example, FIG. 13B shows the elliptical shaped weight 1314 located near the center of bridge member 1308 of golf club head 1300. Again, the elliptical shaped weight 1314 is rotated into a position above the point of engagement with the bridge member 1308 and/or above the point of engagement of the club head 1300 with a golf ball, as indicated by the elevated position of the elliptical portion of the weight 1314, appearing above bridge member 1308 in FIG. 13B. This placement of elliptical shaped weight 1314 will tend to raise the center of gravity of the golf club head 1300 and move it rearward. A golf ball hit with this particular golf club head configuration will tend to propel a golf ball with a lower and more controlled trajectory toward the center of the fairway and/or without a bias for a ball flight to either the right or left side of the fairway.

As a further example, FIG. 13C shows the elliptical shaped weight 1314 located on bridge member 1308 near the heel portion 1302 of golf club head 1300. In addition, the elliptical shaped weight 1314 in this illustrated example is rotated into a position below the point of engagement of the weight 1314 with the bridge member 1308 and/or below the point of engagement of the club head 1300 with a golf ball, as indicated by the appearance of the elliptical portion of the weight 1314 below bridge member 1308 in FIG. 13C. This placement of elliptical shaped weight 1314 will tend to lower and shift the center of gravity of golf club head 1300 rearward toward the heel portion 1302 of golf club head 1300. A golf ball hit with this particular golf club head configuration will tend to propel the golf ball with a higher trajectory toward the left of the fairway for a right-handed golfer (e.g., to help correct a slice, to provide a draw bias for the club, etc.).

Of course, if desired, elliptical shaped weight 1314 may be replaced by alternate weights that have different shapes and/or different masses to increase or decrease the degree to which the center of gravity of club head 1300 is repositioned. Various shapes, such as rectangular, oval, triangular, trapezoidal, square or other symmetrical or asymmetrical shapes may be utilized for the weight member 1314. Elliptical shaped weight 1314 or other desired weighting members may be made of various materials such as lead, stainless steel, carbon steel, titanium, aluminum, tungsten, graphite, polymers, plastics or composites or combinations thereof. The weight also may be placed along the front surface 1316 of the bridge member 1308 without departing from the invention. Any combination of weight member(s) 1314, weight location(s) along the rail 1312, and/or rotational positioning of the elliptical weight(s) 1314 may be used without departing from this invention.

Figure 14:
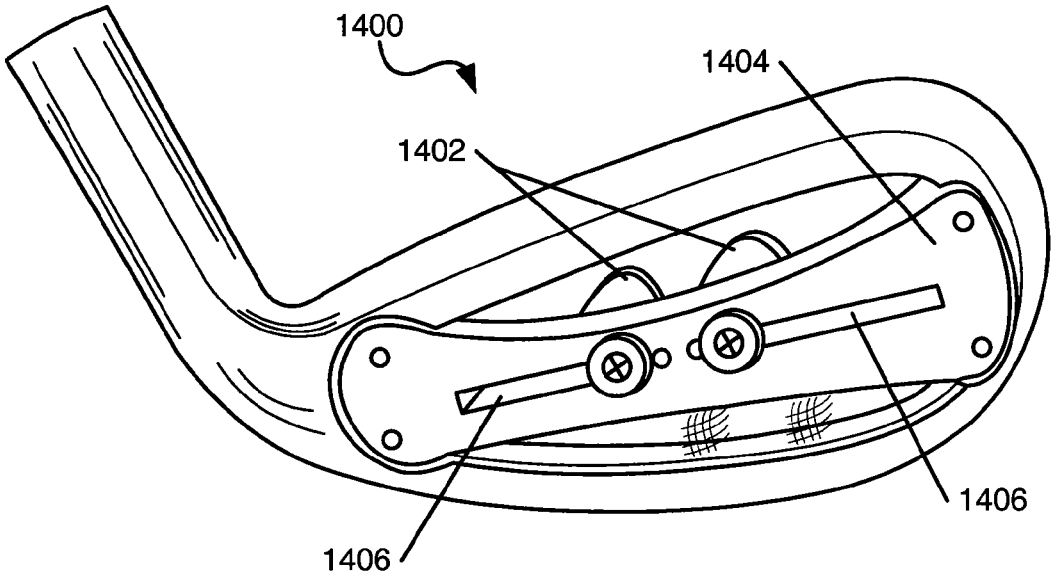
FIG. 14 illustrates a rear view of an example golf club head in accordance with the present invention with a plurality of weights attached to a bridge member.
Figure 15:
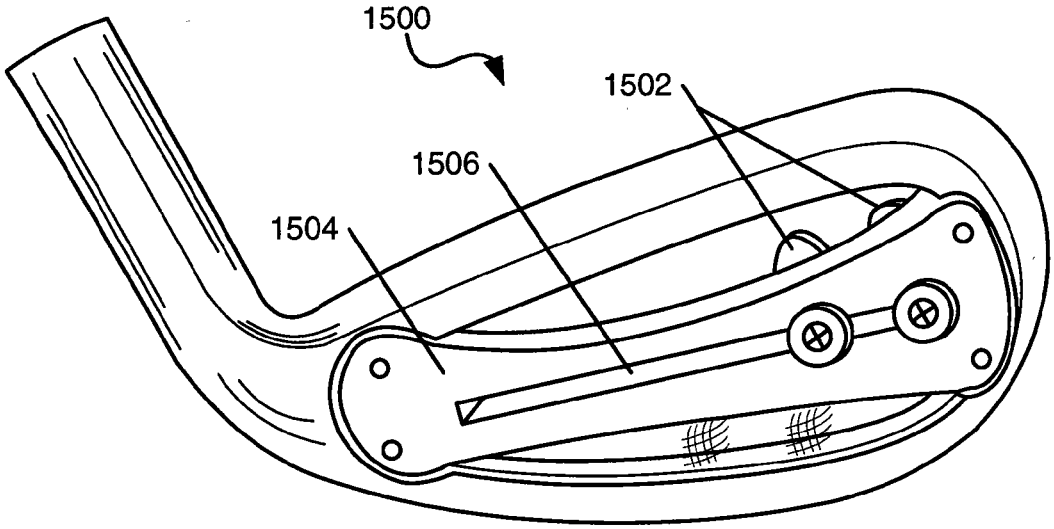
FIG. 15 illustrates a rear view of another example golf club head in accordance with the present invention with a plurality of weights attached to rail assembly integral to a bridge member.

FIGS. 14 and 15 illustrate still additional examples of club head structures 1400 and 1500 with weighting members 1402 and 1502 according to examples of the present invention. In these example structures, a plurality of weights 1402 and 1502 are attached to a bridge member 1404 and 1504 in a combination of configurations, e.g., as previously described above, to vary and control the position of the center of gravity of a golf club head 1400 and 1500. For example, as shown in FIG. 14, a plurality of weights 1402 may be movably attached to plural rails or grooves 1406 provided on a single bridge member 1404, e.g., in the manners described above in conjunction with FIGS. 12A through 13C. When plural rails are present, they may be in any desired arrangement with respect to one another (e.g., essentially collinear, stacked, overlapping, etc.) Alternatively, if desired, the weights 1402 may be positioned at fixed locations on a bridge member, e.g., as described above in conjunction with FIGS. 10A through 11C. As still another option, if desired, one or more weights may be located at a fixed position on a bridge member while one or more other weights are movably connected to a rail or other variable weight positioning assembly. As still another example, as illustrated in FIG. 15, plural weights 1502 may be movably connected to a single rail 1506 on bridge member 1504 to add additional weight to the back of the club head 1500 and to allow one to further vary and control the position of the center of gravity of golf club head 1500. One or more of the weights 1500 may be elliptically shaped, as illustrated in the FIG. 15, or shaped in some other manner without departing from this invention.

While the examples illustrated in FIGS. 9-15 generally show a club head of the type shown in FIGS. 6-9 (e.g., with a wall member 630 provided above the bridge member 624 and a feel altering member 632 provided and visible in the open area below the bridge member 624), those skilled in the art will appreciate that one or more of the same features of the invention shown in FIGS. 9-15 may be practiced in a club head of the type illustrated in FIGS. 1-5A (e.g., with a wall member 230 provided below the bridge member 224 and a feel altering member 232 and/or 234 provided and visible in the open area above the bridge member 224) and/or in a club head that does not include an additional wall member 230 and 630 (e.g., and the feel altering member, when present, may be visible both above and below the bridge member).

Golf club heads in accordance with examples of the present invention may be incorporated into a set, e.g., a set of iron and/or hybrid type golf clubs. For example, aspects of the present invention may be used to provide a club set with increasing numbered iron golf clubs, such as two or more of hybrid type clubs, driving irons, a zero iron, a one iron, a two iron, a three iron, a four iron, a five iron, a six iron, a seven iron, an eight iron, a nine iron, a ten iron, a pitching wedge, a lob wedge, a gap wedge, a sand wedge, etc. With the present invention, a golfer, a club designer, and/or a club fitter may modify the position of the center of gravity for each golf club to meet the player's unique requirements, skill, or playing style. For each club in the set, the bridge member (and/or other features of the club head, such as wall members, feel altering members, weighting members, etc) may progressively change to alter the center of gravity of one club member with respect to the others in the set, to make the center of gravity better suited for use of the particular club, optionally customized for use by a specific golfer.

III. CONCLUSION

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims. For example, the various features and concepts described above in conjunction with FIGS. 1-15 may be used individually and/or in any combination or subcombination without departing from this invention.

We claim:

1. A golf club head, comprising:

a body including a striking face having a contact area for engaging a golf ball and a rear cavity, the rear cavity opposite the striking face;

a bridge member extending across at least a portion of the rear cavity;

an altering element provided between the bridge member and the rear face; and a weight member engaged with the bridge member and provided to affect, at least in part, a position of a center of gravity of the golf club head, wherein the weight member is selectively movable to different locations on the bridge member.

2. A golf club head according to claim 1, wherein the different locations on the bridge member are independent fixed locations.

3. A golf club head according to claim 1, wherein the weight member is rotatable and fixable at different rotational positions to further affect the position of the center of gravity of the golf club head.

4. A golf club head according to claim 1, wherein the weight member is removably mounted on the bridge member.

5. A golf club head according to claim 1, wherein the bridge member further includes a rail formed therein.

6. A golf club head according to claim 5, wherein the weight member is shaped to engage and slide along the rail to vary the position of the center of gravity of the golf club head.

7. A golf club head according to claim 6, further comprising a locking mechanism to secure the weight member to the rail.

8. A golf club head according to claim 1, wherein the altering element includes a polymeric material.

9. A golf club head according to claim 1, wherein the altering element affects a vibrational response of the club head during impact with a golf ball.

10. A golf club head according to claim 1, wherein the altering element defines a fluid-tight chamber.

11. A golf club head according to 10, wherein the chamber includes a gas.

12. A golf club head, comprising:

a body including a heel, a toe, a striking face, the striking face having a contact area for engaging a golf ball, and a rear cavity, the rear cavity opposite the striking face;

a bridge member extending across at least a portion of the rear cavity;

an altering element provided between the bridge member and the rear face; and a weight positioning assembly integral to the bridge member, the weight positioning assembly including a rail and a weight member movably connected to the rail, the weight member being movable along the rail, at least in part, to affect a position of a center of gravity of the golf club head in a first direction, the weight member further being rotatable, at least in part, to further affect the position of the center of gravity of the golf club head in a second direction.

13. A golf club head according to claim 12, wherein the altering element includes a polymeric material.

14. A golf club head according to claim 12, wherein the altering element affects a vibrational response of the club head during impact with a golf ball.

15. A golf club head according to claim 12, wherein the altering element defines a fluid-tight chamber.

16. A golf club head according to claim 15, wherein the chamber includes a gas.

17. A golf club head according to claim 12, wherein the altering element affects a sound generated by the club head during impact with a golf ball.

18. A golf club, comprising:

a body including a striking face having a contact area for engaging a golf ball and a rear cavity, the rear cavity opposite the striking face;

a bridge member extending across at least a portion of the rear cavity;

an altering element provided between the bridge member and the rear face;

a weight member engaged with the bridge member and provided to affect, at least in part, a position of a center of gravity of the golf club head, wherein the weight member is selectively movable to different locations on the bridge member; and a shaft member extending from the body.

19. A golf club according to claim 18, wherein the weight member is rotatable and fixable at different rotational positions, at least in part, to further affect the position of the center of gravity of the golf club head.

20. A golf club according to claim 18, wherein the altering element affect a vibrational response of the club head during impact with a golf ball.

21. A golf club according to claim 18, wherein the altering element defines a fluid-tight chamber.

22. A golf club, comprising:

a body including a heel, a toe, a striking face, the striking face having a contact area for engaging a golf ball, and a rear cavity, the rear cavity opposite the striking face;

a bridge member extending across at least a portion of the rear cavity;

an altering element provided between the bridge member and the rear face;

a weight positioning assembly integral to the bridge member, the weight positioning assembly including a rail and a weight member movably connected to the rail, the weight member being movable along the rail, at least in part, to affect a position of a center of gravity of the golf club head in a first direction, the weight member further being rotatable, at least in part, to further affect the position of the center of gravity of the golf club head in a second direction; and a shaft member extending from the body.

23. A golf club according to claim 22, wherein the altering element affects a vibrational response of the club head during impact with a golf ball.

24. A golf club according to claim 22, wherein the altering element defines a fluid-tight chamber.

25. A golf club head, comprising:

a body including a striking face having a contact area for engaging a golf ball and a rear cavity, the rear cavity opposite the striking face;

a bridge member extending across at least a portion of the rear cavity, wherein the bridge member further includes a rail formed therein;

an altering element provided between the bridge member and the rear face; and a weight member engaged with the bridge member and provided to affect, at least in part, a position of a center of gravity of the golf club head, wherein the weight member is shaped to engage and slide along the rail to vary the position of the center of gravity of the golf club head.

26. A golf club head according to claim 6, further comprising a locking mechanism to secure the weight member to the rail.

* * * * *